US007950647B2

(12) United States Patent
Iguchi et al.

(10) Patent No.: US 7,950,647 B2
(45) Date of Patent: May 31, 2011

(54) SHEET FINISHING APPARATUS, SHEET PUNCHING APPARATUS AND CONTROL METHOD

(75) Inventors: Ken Iguchi, Shizuoka (JP); Katsuya Sasahara, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 255 days.

(21) Appl. No.: 12/402,179

(22) Filed: Mar. 11, 2009

(65) Prior Publication Data

US 2009/0229435 A1 Sep. 17, 2009

Related U.S. Application Data

(60) Provisional application No. 61/036,450, filed on Mar. 13, 2008, provisional application No. 61/036,453, filed on Mar. 13, 2008, provisional application No. 61/042,666, filed on Apr. 4, 2008, provisional application No. 61/042,670, filed on Apr. 4, 2008.

(51) Int. Cl.
*B26F 1/02* (2006.01)
*B65H 37/00* (2006.01)

(52) U.S. Cl. ..... 270/58.07

(58) Field of Classification Search ..... 270/58.01, 270/58.07; 83/684–691

See application file for complete search history.

(56) References Cited

U.S. PATENT DOCUMENTS

| | | | | |
|---|---|---|---|---|
| 2005/0000336 | A1 | 1/2005 | Hattori et al. | |
| 2007/0227324 | A1 * | 10/2007 | Baba | 83/37 |
| 2008/0264226 | A1 | 10/2008 | Iguchi | |
| 2009/0062096 | A1 | 3/2009 | Sasahara | |

FOREIGN PATENT DOCUMENTS

| | | | |
|---|---|---|---|
| JP | 2002-239986 | A | 8/2002 |
| JP | 2004-345834 | A | 12/2004 |
| JP | 2005-075550 | A | 3/2005 |
| JP | 2007-45605 | A | 2/2007 |
| JP | 2007-190634 | A | 8/2007 |
| JP | 2007-190658 | A | 8/2007 |
| JP | 2007-191245 | A | 8/2007 |

* cited by examiner

*Primary Examiner* — Gene Crawford
*Assistant Examiner* — Leslie A Nicholson, III
(74) *Attorney, Agent, or Firm* — Patterson & Sheridan, LLP

(57) ABSTRACT

A drive mechanism which drives a punching blade between a position at a side of a sheet and a standby position separate from the sheet, and a punch motor that rotates in a forward direction and a reverse direction and drives the drive mechanism are provided, a first load of the punch motor at the rotation in the forward direction and a second load of the punch motor at the rotation in the reverse direction are measured in a state where the sheet does not exist, and a drive amount of the punch motor is corrected according to the first load and the second load.

20 Claims, 23 Drawing Sheets

FIG.12
| | T1<br>PWM On Time | T1'<br>PWM 1clock | X<br>REVERSE ROTATION<br>BRAKE TIME |
|---|---|---|---|
| STANDARD PAPER | 1 msec | 7 msec | 10 msec |
| THICK PAPER1 | 1.5 msec | 6.5 msec | 10 msec |
| THICK PAPER 2 | 1.5 msec | 6 msec | 10 msec |
| THICK PAPER 3 | 2.5 msec | 5 msec | 6.5 msec |
| THICK PAPER 4 | 3 msec | 5 msec | 5.5 msec |
| THIN PAPER | 1 msec | 7 msec | 10 msec |
FIG.13A
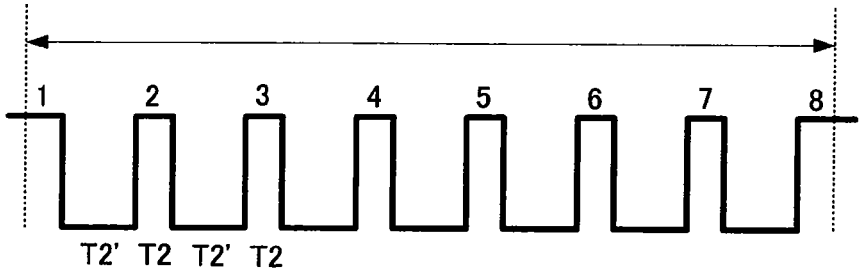
FIG.13B
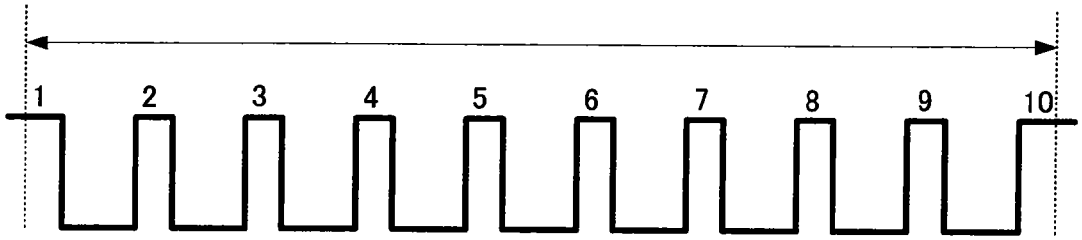

FIG.14A
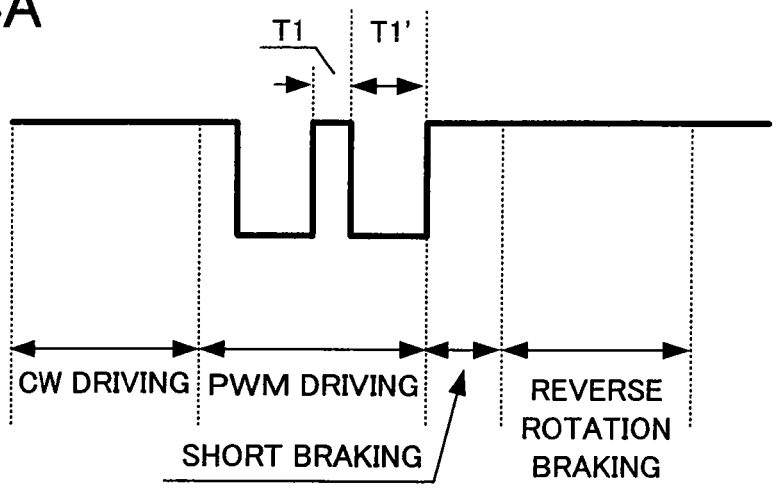
FIG.14B
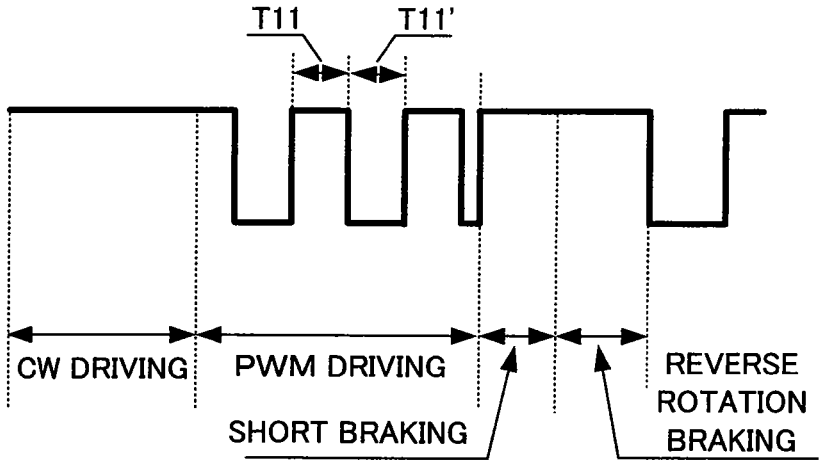
FIG.15
| | MEASUREMENT IN ONE DIRECTION | MEASUREMENT IN BOTH DIRECTION |
|---|---|---|
| AT INITIALIZATION DRIVING AFTER POWER IS TURNED ON | × | ○ |
| AT ANOTHER INITIALIZATION DRIVING | ○ | × |
| AT JOB START | ○ | × |

SHEET FINISHING APPARATUS, SHEET PUNCHING APPARATUS AND CONTROL METHOD

CROSS-REFERENCE TO RELATED APPLICATIONS

This application is based upon and claims the priority of U.S. Provisional Application No. 61/036,450, filed on Mar. 13, 2008, and U.S. Provisional Application No. 61/036,453, filed on Mar. 13, 2008, No. 61/042,666, filed on Apr. 4, 2008, and No. 61/042,670, filed on Apr. 4, 2008, the entire contents of which are incorporated herein by reference.

TECHNICAL FIELD

Described herein relates to a sheet finishing apparatus for finishing a sheet ejected from an image forming apparatus such as a copy machine, a printer or a multi-function peripheral (MFP) and a control method, and particularly to an improvement of a punch unit for forming a punch hole in a sheet.

BACKGROUND

In recent years, in an image forming apparatus (for example, an MFP), a sheet finishing apparatus is provided to be adjacent to the latter stage of the MFP in order to finish a sheet after image formation. The sheet finishing apparatus is called a finisher, and forms a punch hole in a sheet fed from the MFP or staples the sheet. Alternatively, the finisher folds a sheet bundle in half and ejects it.

In order to form the punch hole in the sheet, the finisher includes a puncher having plural punching blades. The punching blade moves up and down by rotation of a punch motor, and the punching blade moves down toward the sheet surface, and forms the punch hole in the sheet. In some puncher, first punching is performed by half rotation of a punch motor in one direction, and next punching is performed by half rotation of the punch motor in the reverse direction.

After forming the punch hole in the sheet, the puncher stops the punching blade at an upper position and stands by. When the punching blade is separated from the paper surface, is moved up and is located at a standby position, the standby position is the home position.

In a related art puncher, after the punch hole is formed in the sheet, the punching blade is stopped at the home position. However, since a punching time is short, the punch motor is required to be rotated at high speed. However, in the case the punch motor is driven at high speed, when the punching blade is attempted to be stopped at the home position, even if the punch motor is braked, it is difficult to stop the punching blade at the home position. Accordingly, when the punch motor is stopped, the motor is rotated in the reverse rotation direction to be braked and is stopped.

Besides, since a load caused when the punching blade is operated varies due to an assembly error of parts constituting the puncher and a difference in environment such as low temperature and low humidity, it is difficult to accurately stop the punch motor. For example, when the reverse rotation braking is applied to the punch motor to stop it, when the load is low, the punch motor may exceed the expected position and stop at a position where the motor overruns in the opposite direction.

JP-A-2007-191245 discloses a sheet punching apparatus in which a load of a puncher is measured, and the drive amount of a punching blade is corrected based on the measurement result.

JP-A-2004-345834 and JP-A-2005-75550 disclose a sheet punching apparatus in which a slide link is moved by a DC motor, and a punch blade is moved up and down by sliding of the slide link. Besides, a stop control of the DC motor is described.

Besides, JP-A-2007-45605 discloses a sheet punching apparatus in which reverse rotation braking is applied and a punch blade is controlled to a home position.

However, in a puncher in which a punch motor is rotated in a forward direction to form a punch hole, and the punch motor is rotated in a reverse direction to form a punch hole, since a load in the forward driving and a load in the reverse driving are different, there is a defect that an error occurs when the punching blade is stopped at the home position. When the punching blade is not at the home position, there occurs a defect that when a punch hole is formed in a next sheet, a position shift occurs, or punching is not well performed.

SUMMARY

Described herein relates to a sheet finishing apparatus comprising:

a punching blade that forms a punch hole in a sheet supplied from an image forming apparatus;

a drive mechanism which drives the punching blade between a penetrate position where the punch hole is formed in the sheet and a standby position separate from the sheet;

a punch motor that rotates in a forward direction and a reverse direction to drive the drive mechanism;

a detection section that rotates together with the punch motor and detects a position of the punching blade;

a drive control section that controls the punch motor using position information of the punching blade detected by the detection section and stops the punching blade at the standby position; and a correction control section that measures a first load of the punch motor at the rotation in the forward direction and a second load of the punch motor at the rotation in the reverse direction before the sheet is supplied from the image forming apparatus, and corrects a drive amount of the punch motor after the sheet is supplied from the image forming apparatus according to the first load and the second load.

DESCRIPTION OF THE DRAWINGS

FIG. 12 is an explanatory view for explaining driving of the punch motor corresponding to the thickness of a sheet.

FIGS. 13A and 13B are waveform views for explaining the measurement of a load of the punch motor.

FIGS. 14A and 14B are waveform views for explaining a correction operation of a drive waveform according to a load variation of the punch motor.

FIG. 15 is an explanatory view for explaining rotation directions of the punch motor and measurement timings of the load.

DETAILED DESCRIPTION

Figure 1:
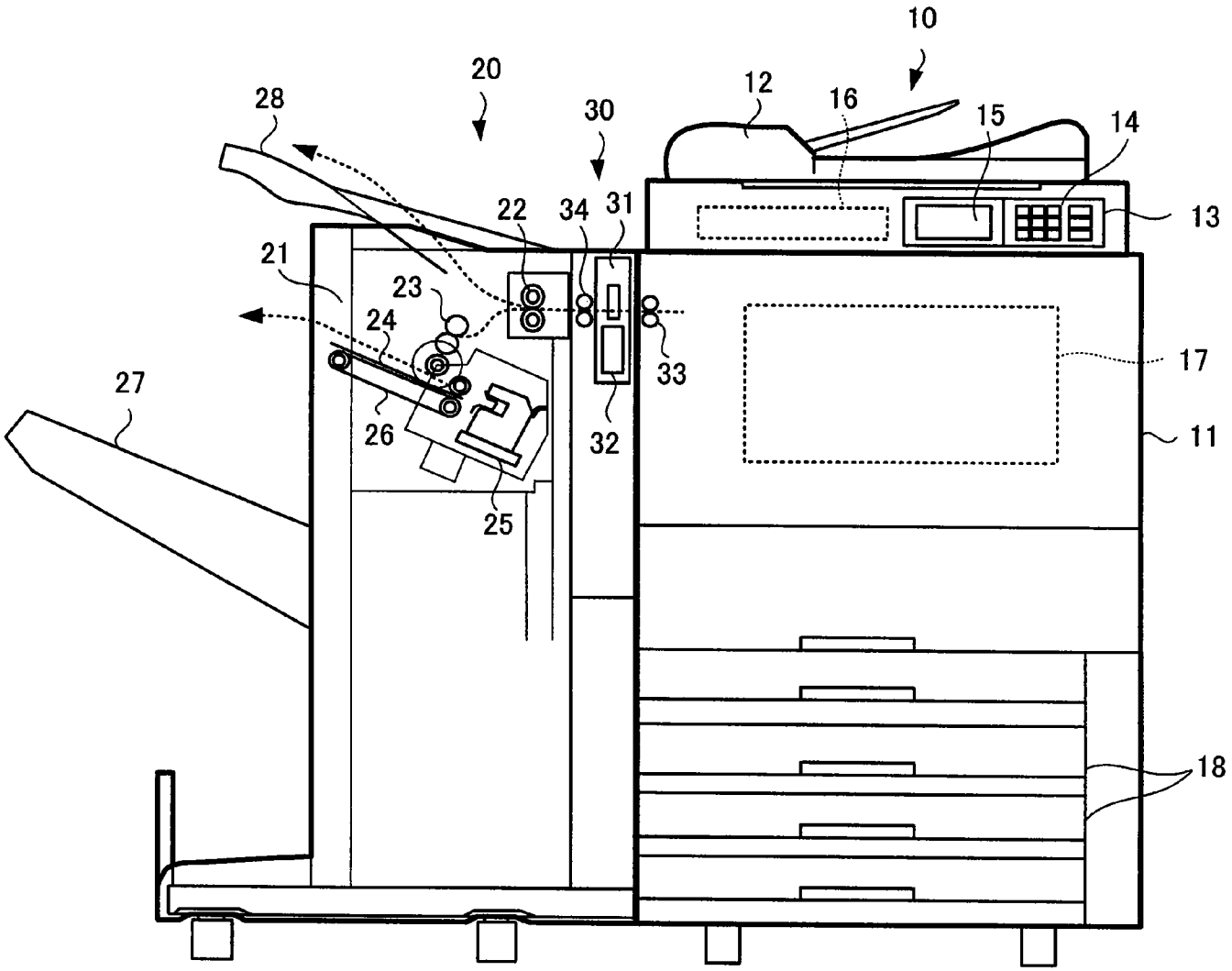
FIG. 1 is a whole structure view showing an embodiment of a sheet finishing apparatus.

Throughout this description, the embodiments and examples shown should be considered as exemplars, rather than limitations on the apparatus of the present invention.

Hereinafter, an embodiment of a sheet finishing apparatus will be described in detail with reference to the drawings. Incidentally, in the respective drawings, the same portions are denoted by the same reference numerals.

FIG. 1 is a structure view showing an image forming apparatus including a sheet finishing apparatus.

In FIG. 1, reference numeral 10 denotes an image forming apparatus such as, for example, an MFP (Multi-Function Peripherals) as a compound machine, a printer, or a copy machine. A sheet finishing apparatus 20 is disposed to be adjacent to the image forming apparatus 10. A sheet on which an image is formed by the image forming apparatus 10 is conveyed to the sheet finishing apparatus 20.

The sheet finishing apparatus 20 performs a finishing on the sheet supplied from the image forming apparatus 10, and performs, for example, punching, sorting, stapling and the like. As the need arises, the sheet is folded in half and is ejected. The sheet finishing apparatus 20 is hereinafter referred to as the finisher 20.

In FIG. 1, a document table is provided at an upper part of a main body 11 of the image forming apparatus 10, and an automatic document feeder (ADF) 12 is openably and closably provided on the document table. An operation panel 13 is provided at an upper part of the main body 11. The operation panel 13 includes an operation section 14 provided with various keys and a touch panel type display section 15.

A scanner section 16 and a printer section 17 are included in the inside of the main body 11, and plural cassettes 18 containing various sizes of sheets are provided at a lower part of the main body 11. The scanner section 16 reads a document sent by the ADF 12 or a document placed on the document table.

The printer section 17 includes a photoconductive drum and a laser, scans and exposes the surface of the photoconductive drum with a laser beam from the laser, and forms an electrostatic latent image on the photoconductive drum. A charger, a developing device, a transfer device and the like are disposed around the photoconductive drum. The electrostatic latent image on the photoconductive drum is developed by the developing device, and a toner image is formed on the photoconductive drum. The toner image is transferred to a sheet by the transfer device. The structure of the printer 17 is not limited to the above example, and various systems can be adopted.

The sheet on which the image is formed by the main body 11 is conveyed to the finisher 20. In the example of FIG. 1, the finisher 20 includes a staple unit 21 that staples a sheet bundle, and a punch unit 30 that forms a punch hole in a sheet. The sheet finished by the finisher 20 is ejected to a storage tray 27 or a fixed tray 28.

The staple unit 21 will be described in brief. The sheet S supplied from the punch unit 30 is received by an inlet roller 22 of the staple unit 21 through a conveyance roller 34. A paper feed roller 23 is provided downstream of the inlet roller 22, and the sheet S received by the inlet roller 22 is stacked on a processing tray 24 through the paper feed roller 23.

The sheet stacked on the processing tray 24 is guided to a stapler 25 and is stapled. Besides, a conveyance belt 26 that conveys the sorted or stapled sheet S to the storage tray 27 is provided. The sheet S conveyed by the conveyance belt 26 is ejected to the storage tray 27, and the storage tray 27 moves up and down to receive the sheet S.

There is also a case where the sheet S is not stapled and is ejected to the storage tray 27. When the sheet S is not stapled, the sheet S is not dropped to the processing tray 24 and is ejected.

The staple unit 21 includes an alignment device to align the conveyed sheet in a width direction, and can also sort and eject the sheet by using the alignment device. Incidentally, when the finishing is not performed, the sheet conveyed from the main body 11 is immediately ejected to the storage tray 27 or the fixed tray 28.

On the other hand, the punch unit 30 is disposed between the main body 11 and the staple unit 20, and includes a punch box 31 and a dust box 32.

The punch box 31 includes a punching blade that punches the sheet, and the punching blade moves down to form a punch hole in the sheet. Punch dust generated by the punching drops into the dust box 32.

Plural rollers 33 and 34 for sheet conveyance are provided on a path extending from the main body 11 to the staple unit 21. The roller 33 is supported by the main body 11, and the roller 34 is located at the final outlet of the punch unit 30. The sheet ejected from the main body 11 is conveyed by the roller 33 to the punch unit 30, and is conveyed to the staple unit 21 by the roller 34. The punching by the punch unit 30 is performed when the user operates the operation panel 13 and sets the punch mode.

Figure 2:
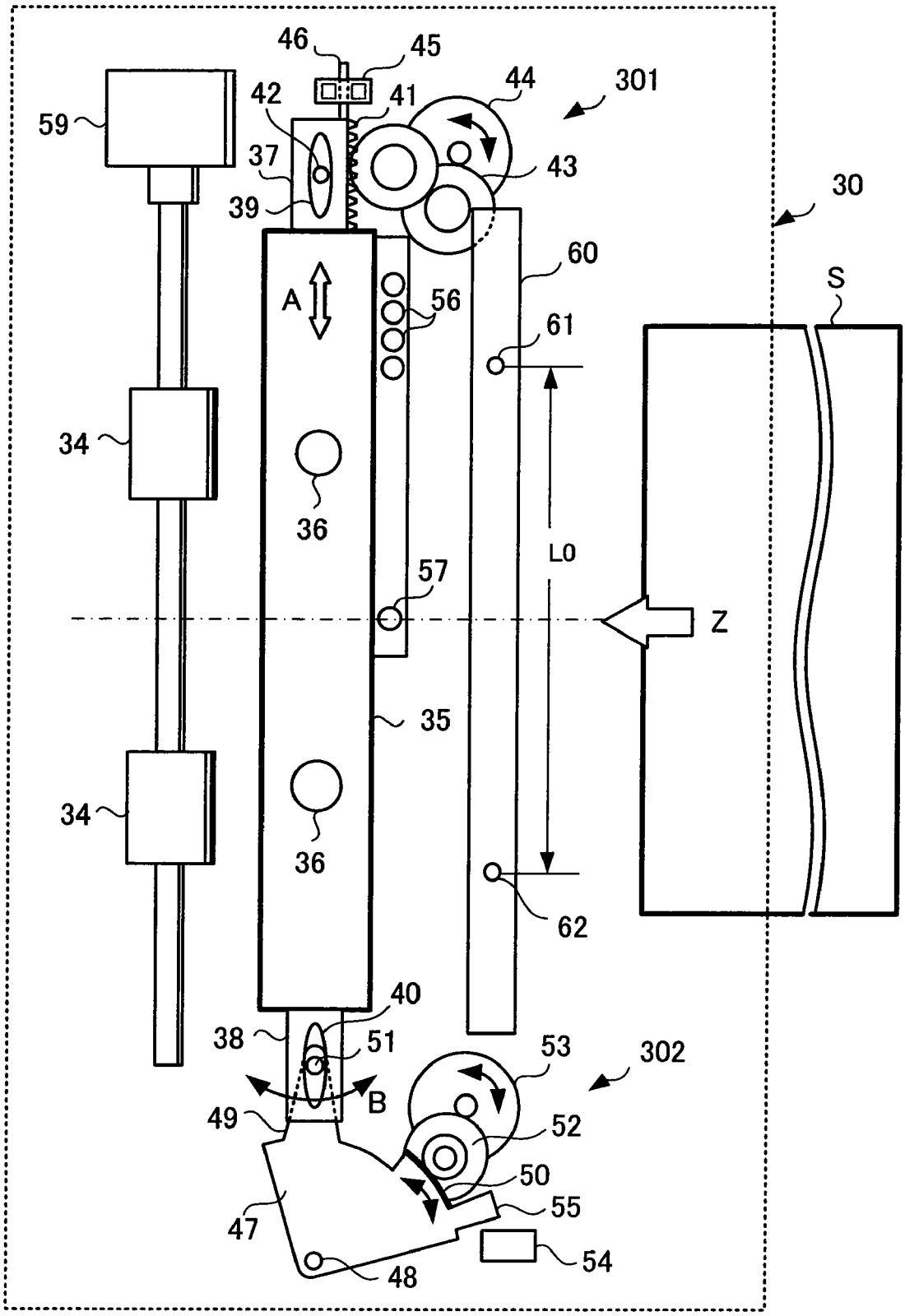
FIG. 2 is a plan view of a punch unit.

FIG. 2 shows a specific structure of the punch unit 30.

The punch unit 30 has a function to form a punch hole in the sheet S and a function to correct a skew of the sheet S. The punch unit 30 includes a puncher 35 that forms the punch hole in the sheet S conveyed from the main body 11, and a skew detection section 60 that detects the skew. The puncher 35 is provided downstream of the skew detection section 60.

The skew detection section 60 and the puncher 35 are orthogonal to a conveyance direction Z of the sheet S. The puncher 35 includes plural (two in FIG. 2) punching blades 36.

Figure 3:
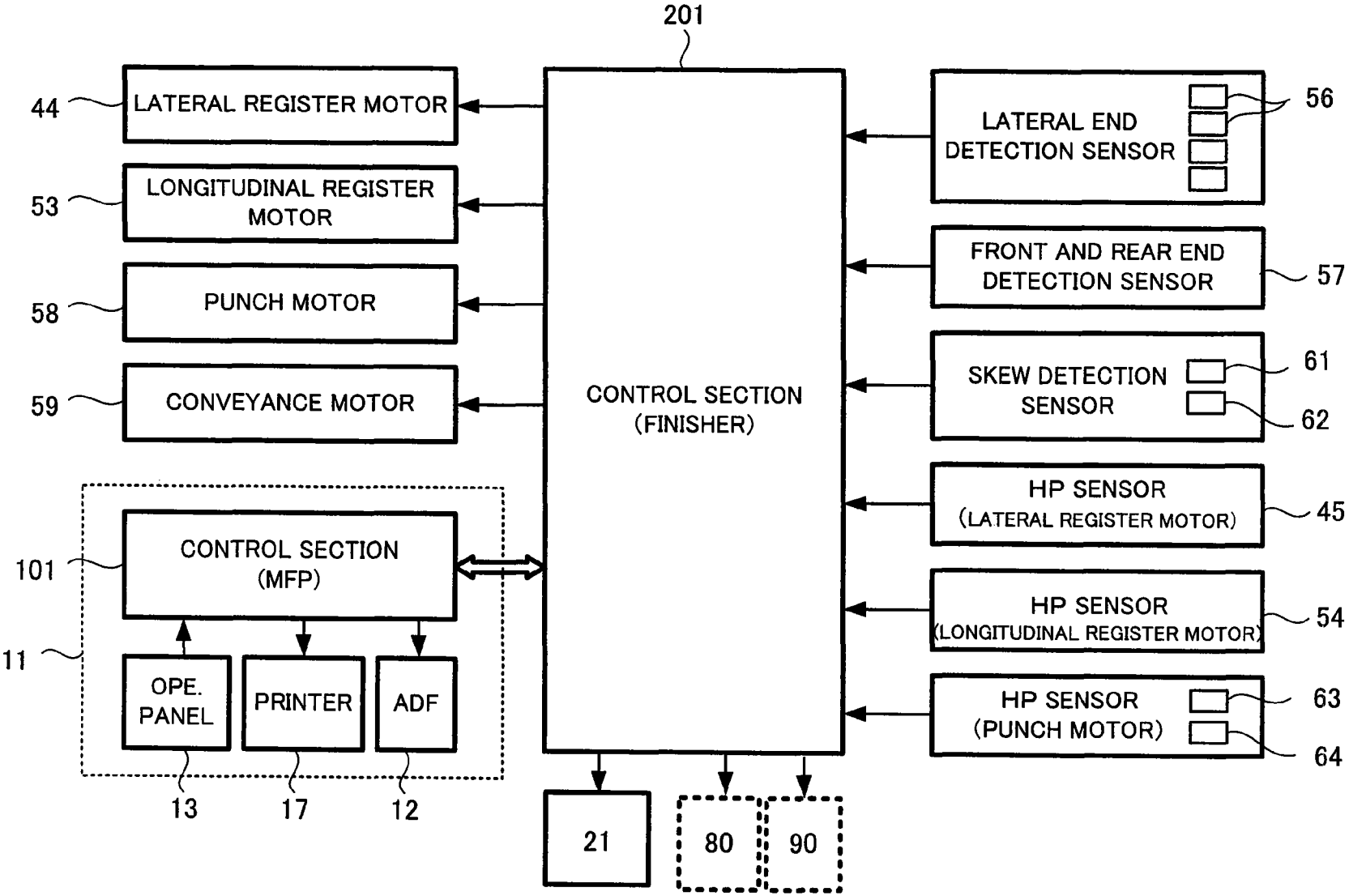
FIG. 3 is a block diagram of a control system of the sheet finishing apparatus.

The punching blade 36 moves up and down by rotation of a punch motor 58 (FIG. 3). The punching blade 36 moves down toward the paper surface of the sheet S so that the punch hole is formed in the sheet S. Incidentally, since the lifting mechanism of the punching blade 36 is generally well known, its illustration is omitted.

The puncher 35 can move in an arrow A direction (lateral direction) orthogonal to the conveyance direction Z of the sheet S, and one end (lower end in the drawing) of the puncher 35 is rotated in an arrow B direction (longitudinal direction) along the conveyance direction of the sheet S.

Protruding pieces 37 and 38 are respectively provided at both ends of the puncher 35 in the axial direction, and long holes 39 and 40 are formed in the protruding pieces 37 and 38. A rack 41 is formed on the side surface of the one protruding piece 37. A fixed shaft 42 provided on the main body side of the finisher 20 is fitted in the long hole 39 of the protruding piece 37. Accordingly, the puncher 35 can move in the arrow A direction within the range of the length of the long hole 39 while the fixed shaft 42 is made a guide.

A gear group 43 which is engaged with the rack 41 and is rotated moves the puncher 35 in the lateral direction (A direction). A lateral register motor 44 rotates the gear group 43.

A sensor 45 is provided at a position separate from the protruding piece 37. The sensor 45 detects that the puncher 35 moves in the arrow A direction and reaches a home position. The protruding piece 37 is provided with a shutter 46 extending in a direction toward the sensor 45, and when the shutter 46 crosses the sensor 45, it is detected that the puncher 35 moves to the home position in the A direction.

On the other hand, the protruding piece 38 of the puncher 35 is coupled to a fan-shaped cam 47 to rotate the puncher 35 in the arrow B direction. The cam 47 is rotated around a shaft 48 provided on the main body side of the finisher 20, includes a lever 49 at one end, and has a gear 50 at the other end. The lever 49 is provided with a shaft 51, and the shaft 51 is fitted in the long hole 40 of the protruding piece 38.

A gear group 52 which is engaged with a gear 50 and is rotated is provided in order to rotate the puncher 35 in the longitudinal direction (B direction), and a longitudinal register motor 53 for rotating the gear group 52 is provided. The cam 47 is rotated by rotation of the longitudinal register motor 53, the lever 49 is rotated by rotation of the cam 47, and the puncher 35 rotates in the longitudinal direction (B direction) around the fixed shaft 42.

A sensor 54 is located at a position separate from the cam 47. The sensor 54 detects that the puncher 35 rotates in the arrow B direction and rotates to the home position. The cam 47 has a shutter 55 extending in a direction toward the sensor 54. When the shutter 55 crosses the sensor 54, it is detected that the puncher 35 rotates to the home position.

As stated above, the puncher 35 moves in the lateral direction (A direction) by the rotation of the lateral register motor 44, and can rotate in the longitudinal direction (B direction) by the longitudinal register motor 53.

Incidentally, a movement mechanism 301 is for moving the puncher 35 in the lateral direction (arrow A direction), and a posture control mechanism 302 controls the posture by rotating the puncher 35 in the longitudinal direction (arrow B direction). The movement mechanism 301 in the lateral direction and the posture control mechanism 302 in the longitudinal direction constitute a movable mechanism for changing the position and the inclination angle of the puncher 35.

Incidentally, as the lateral register motor 44 and the longitudinal register motor 53, it is appropriate to use a stepping motor whose rotation speed can be controlled by the number of pulses or a frequency. The movement distance of the puncher 35 in the lateral direction can be managed by the number of pulses when the lateral register motor 44 is driven. The rotation control of the puncher 35, that is, the angle can be managed by the number of pulses when the longitudinal register motor 53 is driven.

Besides, a sensor group 56 that detects an end (lateral end) of the sheet S in the lateral direction and a sensor 57 that detects an end (front end and rear end) in the longitudinal direction when the sheet S is conveyed are provided at the sheet S carrying-in side of the puncher 35.

In each of the sensor group 56 and the sensor 57, for example, a light emitting element and a light receiving element are disposed to be opposite to each other, and when the sheet S is conveyed and passes through between the light emitting element and the light receiving element, the lateral end, the front end and the rear end of the sheet S are detected.

The skew detection section 60 includes sensors 61 and 62 for skew detection. Each of the sensors 61 and 62 includes, for example, a light emitting element and a light receiving element opposite to the light emitting element. The sensors 61 and 62 detect the skew of the sheet S passing through between the light emitting element and the light receiving element.

The sensors 61 and 62 are located at the upstream side of the punch nit 30. The sensors 61 and 62 detect the passing of the front end and the rear end of the sheet S. The sensor 61 and the sensor 62 are spaced from each other by a distance L0, and are disposed side by side to be orthogonal to the sheet conveyance direction.

Detection signals from the sensors 61 and 62 are sent to a control section described later. The control section includes a timer counter, and the timer counter starts time measurement when the sensor 61 or 62 detects the passing of the front end of the sheet S. When the sheet S is not inclined with respect to the conveyance direction, since the sensors 61 and 62 simultaneously detect the passing of the front end of the sheet S, the respective timer counters simultaneously start counting, and a time difference does not occur.

When the sheet S is inclined and is conveyed, since a time difference occurs in the passing of the sheet S detected by the first sensor 61 and the second sensor 62, it can be known that the sheet S is skewed.

A skew error distance (a) can be obtained from a difference between the time when the sensor 61 detects the sheet S and the time when the sensor 62 detects the sheet S, and a conveyance speed V of the sheet S. Besides, when the distance between the first sensor 61 and the second sensor 62 is L0, and the skew angle is (θ), the following expression (1) is established.

$$a = L0 \cdot \tan\theta \quad (1)$$

When the skew angle θ is obtained from the expression (1), the longitudinal register motor 53 is rotated by the angle θ to rotate the puncher 35, and the skew correction is performed according to the skew amount of the sheet.

Besides, a conveyance roller 34 is driven by a conveyance motor 59, and conveys the sheet S conveyed from the upstream side (inlet side to the punch unit 30) to the downstream side (outlet side of the punch unit 30) at the conveyance speed V. The conveyance motor 59 rotates, for example, at a constant rotation speed.

Next, the control system of the finisher 20 will be described with reference to a block diagram of FIG. 3.

In FIG. 3, a control section 201 controls the finisher 20 and includes a CPU (Central Processing Unit) a RAM, a ROM and the like. The control section 201 is connected with the sensor group 56 for lateral end detection, the sensor 57 for detecting the front end and rear end of the sheet S, the sensors 61 and 62 for skew detection, and the home position sensors 45, 54, 63 and 64. Detection results from the respective sensors are inputted to the control section 201.

Besides, the control section 201 is connected with the lateral register motor 44, the longitudinal register motor 53, the punch motor 58, and the conveyance motor 59. The control section 201 controls the rotation of the respective motors in response to the detection results of the above sensors.

The home position sensor 45 detects the home position when the puncher 35 is moved in the lateral direction (A direction) by the lateral register motor 44. The home position in the lateral direction is the center of the conveyance path of the sheet S.

The home position sensor 54 detects the home position when the puncher 35 is rotated in the longitudinal direction (B direction) by the longitudinal register motor 53. The home position in the longitudinal direction is the position where the puncher 35 is most inclined.

The home position sensors 63 and 64 detect the home position when the punching blade 36 moves up and down by the punch motor 58. The home position of the punching blade 36 is a state where the punching blade 36 is pulled out from the sheet S, that is, a standby position separate from the paper surface of the sheet S.

The control section 201 is connected to a control section 101 that controls the main body (MFP) 11. The control section 101 is connected with respective sections of the main body 11, for example, the operation panel 13, the printer section 17, the ADF 12 and the like. The control section 201 controls the staple unit 21. When a saddle unit 80 and a creasing unit 90 described later are included, the control section 201 controls the saddle unit 80 and the creasing unit 90.

The control section 201 and the control section 101 operate in cooperation with each other, and instruct stapling, punching, or folding by the operation of the operation panel 13. Besides, the designation of the sheet size, the instruction of the number of copies and the like are performed by the operation of the operation panel 13.

Next, the basic operation of the punch unit 30 will be described with reference to FIGS. 4A and 4B and FIGS. 5A and 5B. FIG. 4A shows an initial state of the punch unit 30. When receiving the instruction of punching from the main body 11, the control section 201 drives the longitudinal register motor 53, and rotates the puncher 35 in an arrow B1 direction along the conveyance direction of the sheet S and sets it in an inclined state. The state where the puncher is rotated in the arrow B1 direction and is inclined is the home position in the longitudinal direction.

Besides, the control section 201 drives the lateral register motor 44, moves the puncher 35 by the gear group 43 in an arrow A1 direction crossing the conveyance direction of the sheet S, and sets it at a retracted position.

When the sheet S is carried in, the skew detection section 60 detects the skew amount of the front end of the sheet S. When the skew amount is detected, the control section 201 drives the longitudinal register motor 53, and, as shown in FIG. 4B, inclines the puncher 35 in an arrow B2 direction in conformity to the skew amount of the sheet S.

Figure 4B:
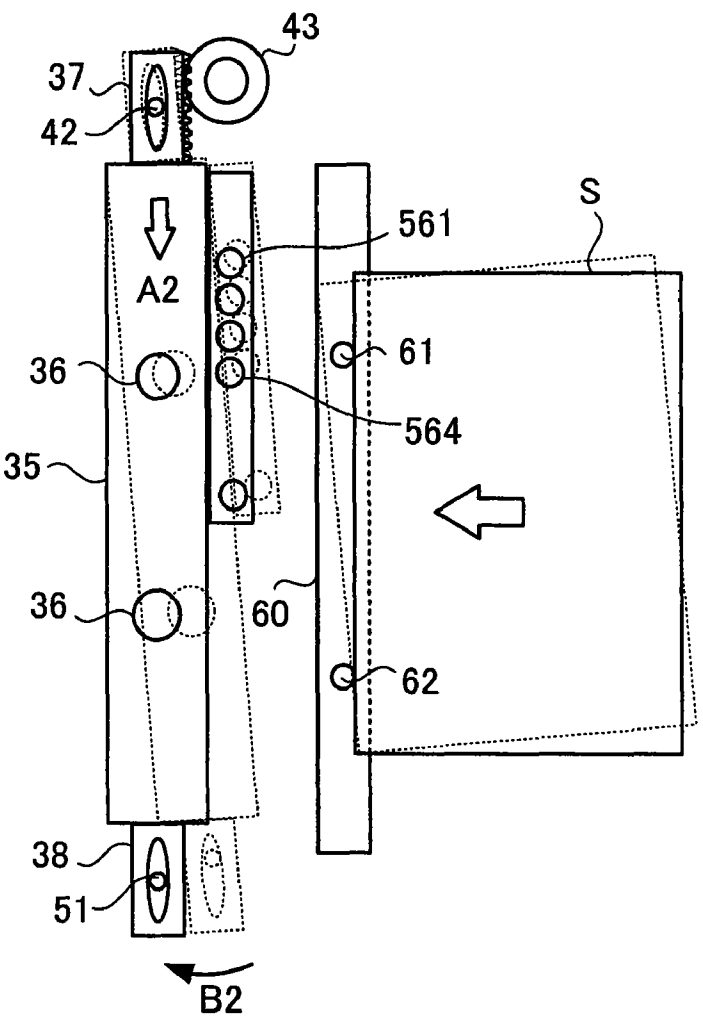
FIGS. 4A and 4B and FIGS. 5A and 5B are plan views showing a basic operation of the punch unit.
Figure 4A:
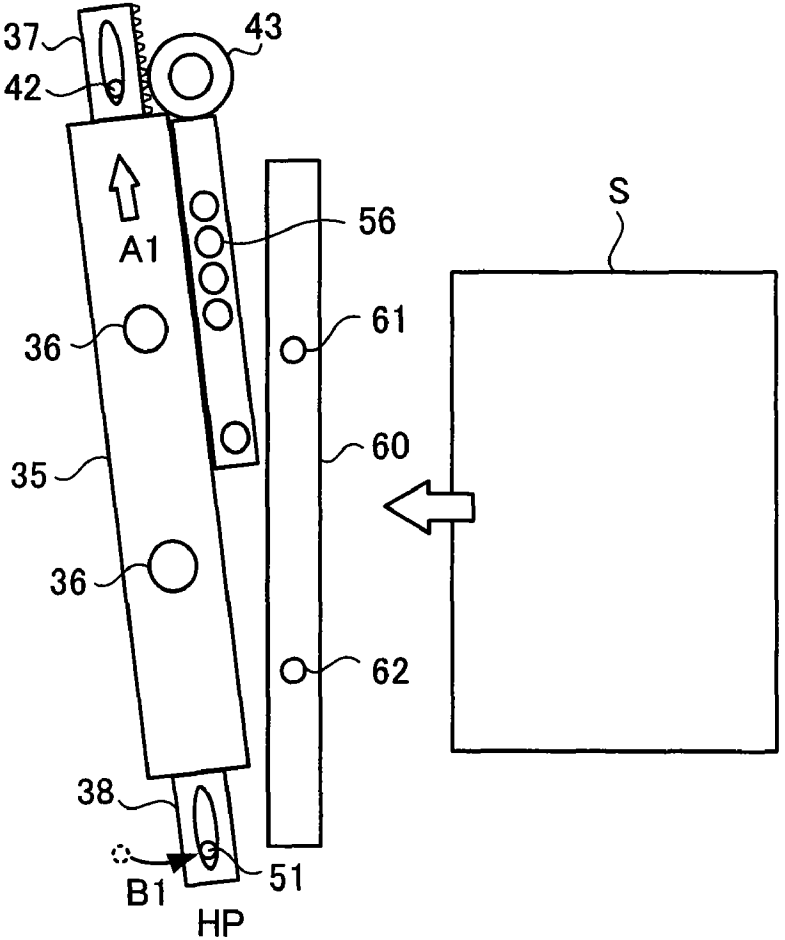

A thin dotted line of FIG. 4B indicates a state where the puncher 35 is inclined in conformity to the skewed sheet S. When there is no skew of the sheet S, as indicated by a solid line, the puncher 35 is orthogonal to the conveyance direction of the sheet S.

Next, when the sensor 57 detects the front end of the sheet S, and it is detected that the sheet S is conveyed by a specified amount, the lateral register motor 44 is driven to move the puncher 35 from the retracted position to the center of the conveyance path in an arrow A2 direction. When the puncher moves in the arrow A2 direction, the sensor group 56 detects the lateral end of the sheet S along the conveyance direction.

In the lateral end detection, a sensor in the sensor group 56 is specified according to the sheet size indicated by the operation panel 13, and the specified sensor detects the lateral end. For example, the lateral end of the A4 size is detected using an outside sensor 561. When the sheet size is small, an inside sensor 564 is used to detect. After the lateral end is detected by a sensor of the sensor group 56, the lateral register motor 44 is stopped, and the movement of the puncher 35 is also stopped.

Figure 5B:
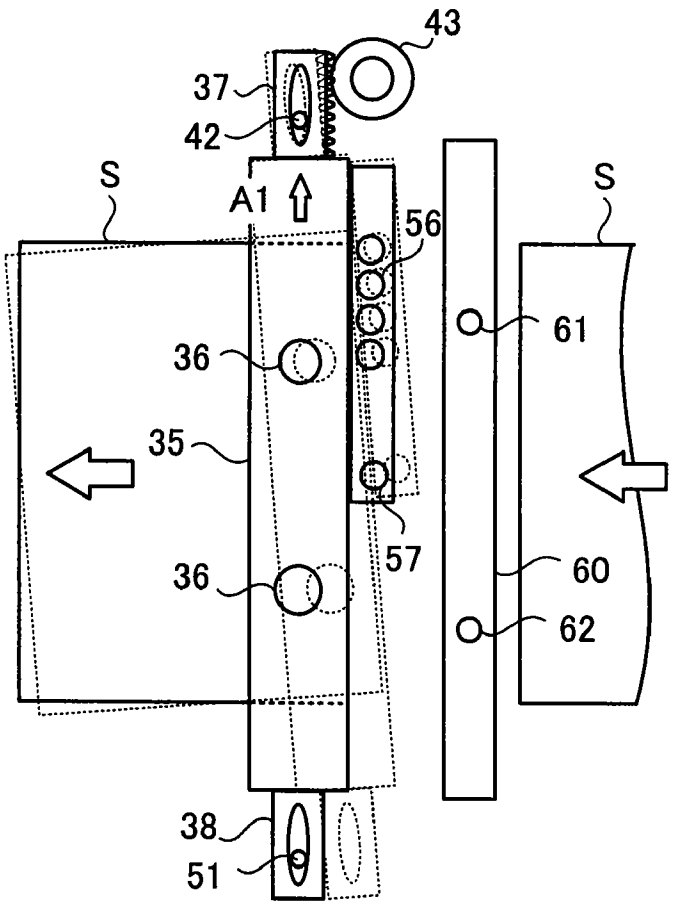
Figure 5A:
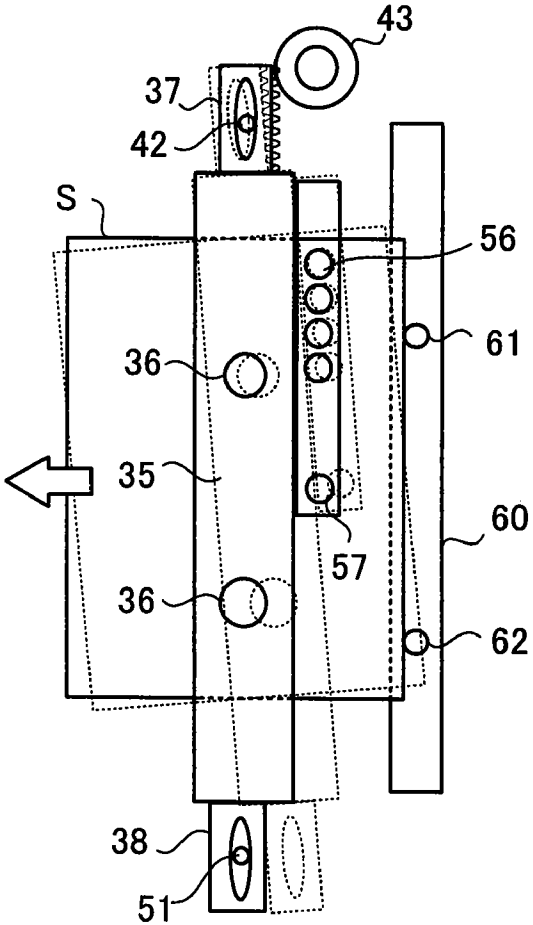

When the conveyance of sheet S is continued, as shown in FIG. 5A, the skew detection section 60 detects the skew amount of the rear end of the sheet S. When there is an error between the skew amount of the front end and the skew amount of the rear end, the longitudinal register motor 53 is driven, and the inclination of the puncher 35 is finely adjusted by the amount of the error. When there is a shift at the lateral end of the sheet S, the lateral register motor 44 is driven, and the position of the puncher 35 in the lateral direction is also finely adjusted.

As shown in FIG. 5B, after the rear end of the sheet S is detected by the sensor 57, the sheet S is conveyed from the position where the rear end is detected to the specified position where punching is performed, and the conveyance motor 59 is stopped. The punch motor 58 is driven in the state where the conveyance motor 59 is stopped, and the punching blade 36 is moved down to form a punch hole in the sheet S.

With respect to the driving of the punch motor 58, in view of the time required for the punching blade 36 to contact with the sheet, the driving may be started at a timing earlier than the stop of the conveyance motor 59. When the driving is started at the earlier timing, the driving of the punch motor 58 is started after a previously set time passes since the rear end of the sheet S was detected by the sensor 57.

When the punching of the punch hole is ended, the control section 201 again drives the conveyance motor 59 to eject the punched sheet. When there is a next sheet, the operation of FIG. 4A to FIG. 5B is repeated, and when there is no subsequent sheet, the respective devices are set at the home positions (HP) and the operation is ended.

Figure 6:
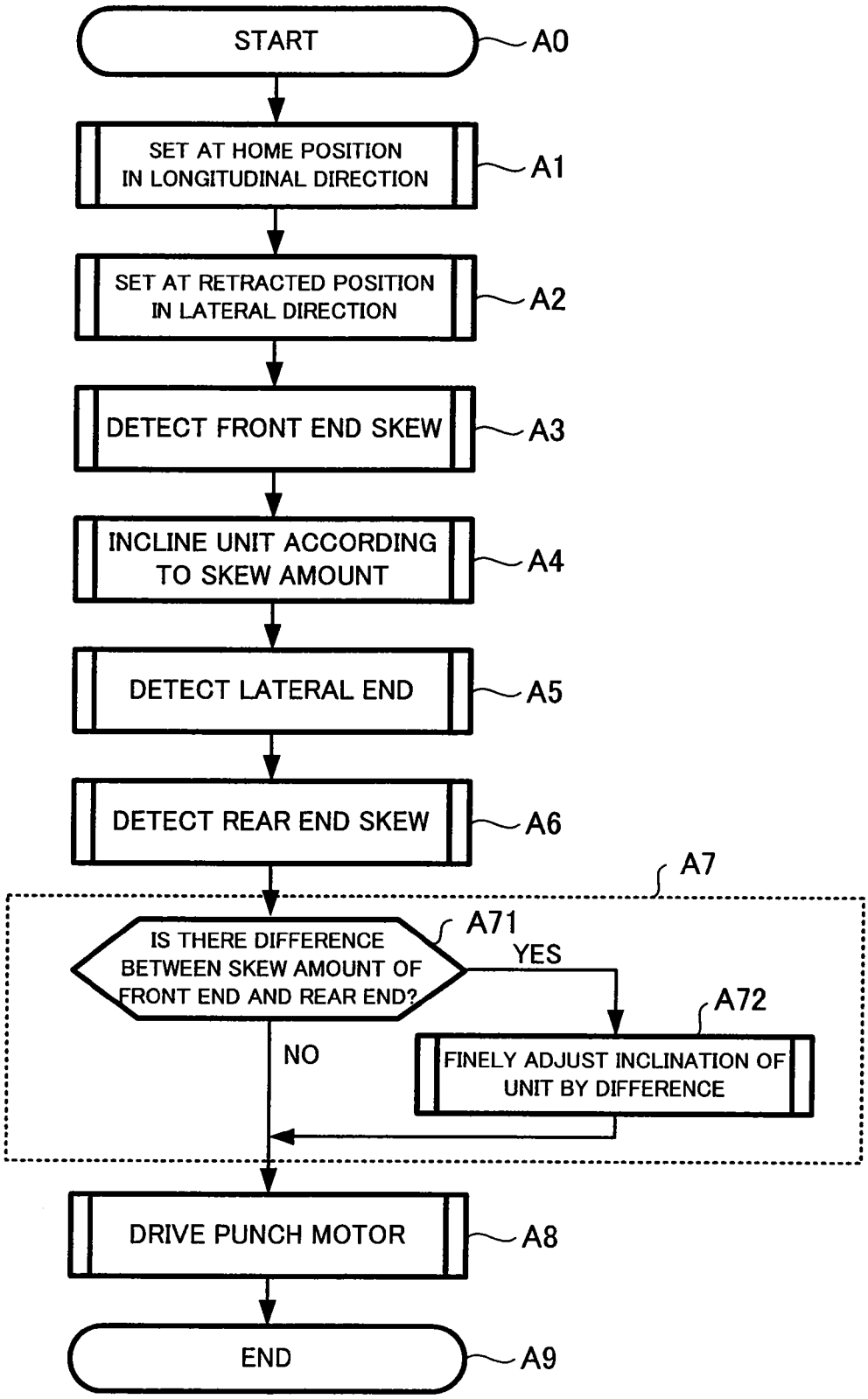
FIG. 6 is a flowchart showing an operation of the punch unit.

FIG. 6 is a flowchart for explaining the above operation.

In FIG. 6, Act A0 is a start step of punching. At Act A1, the longitudinal register motor 53 is driven, and the puncher 35 is rotated to be set at the home position in the longitudinal direction. At Act A2, the lateral register motor 44 is driven, and the puncher 35 is moved in the arrow A1 direction orthogonal to the conveyance direction of the sheet S and is set at the retracted position.

At Act A3, the skew detection section 60 detects the skew of the front end of the carried-in sheet S. When the skew detection section 60 detects the skew amount, at Act A4, the longitudinal register motor 53 is driven, and the puncher 35 is rotated in conformity to the skew amount of the carried-in sheet S and is inclined.

When the sensor 57 detects the front end of the sheet S, the lateral register motor 44 is driven, and the puncher 35 is moved from the retracted position to the center of the conveyance path. At Act A5, the sensor group 56 detects the lateral end of the sheet S. After the lateral end is detected, the lateral register motor 44 is stopped, and the movement of the puncher 35 is also stopped. When the conveyance of the sheet S is continued, at Act A6, the skew detection section 60 detects the skew amount of the rear end of the sheet S.

At Act A71 of Act A7, it is determined whether there is an error between the skew amount of the front end and the skew amount of the rear end. When there is an error, at A72, the longitudinal register motor 53 is driven to finely adjust the inclination of the puncher 35 by the amount of the error. When there is a shift at the lateral end of the sheet S, the lateral register motor 44 is driven, and the puncher 35 is finely adjusted also in the lateral direction.

After the skew correction is performed, the sheet S is conveyed to the specified position where punching is performed, and the driving of the conveyance motor 59 is stopped. At Act A8, the punch motor 58 is driven to lower the punching blade 36, and a punch hole is formed in the sheet S. When the punching of the punch hole is ended, the conveyance motor 59 is again driven to eject the sheet subjected to the punch process. When there is a next sheet, the process from Act A1 to Act A8 is repeated, and when there is no subsequent sheet, the respective devices are set at the home positions (HP), and the punch process is ended at Act A9.

Figure 7:
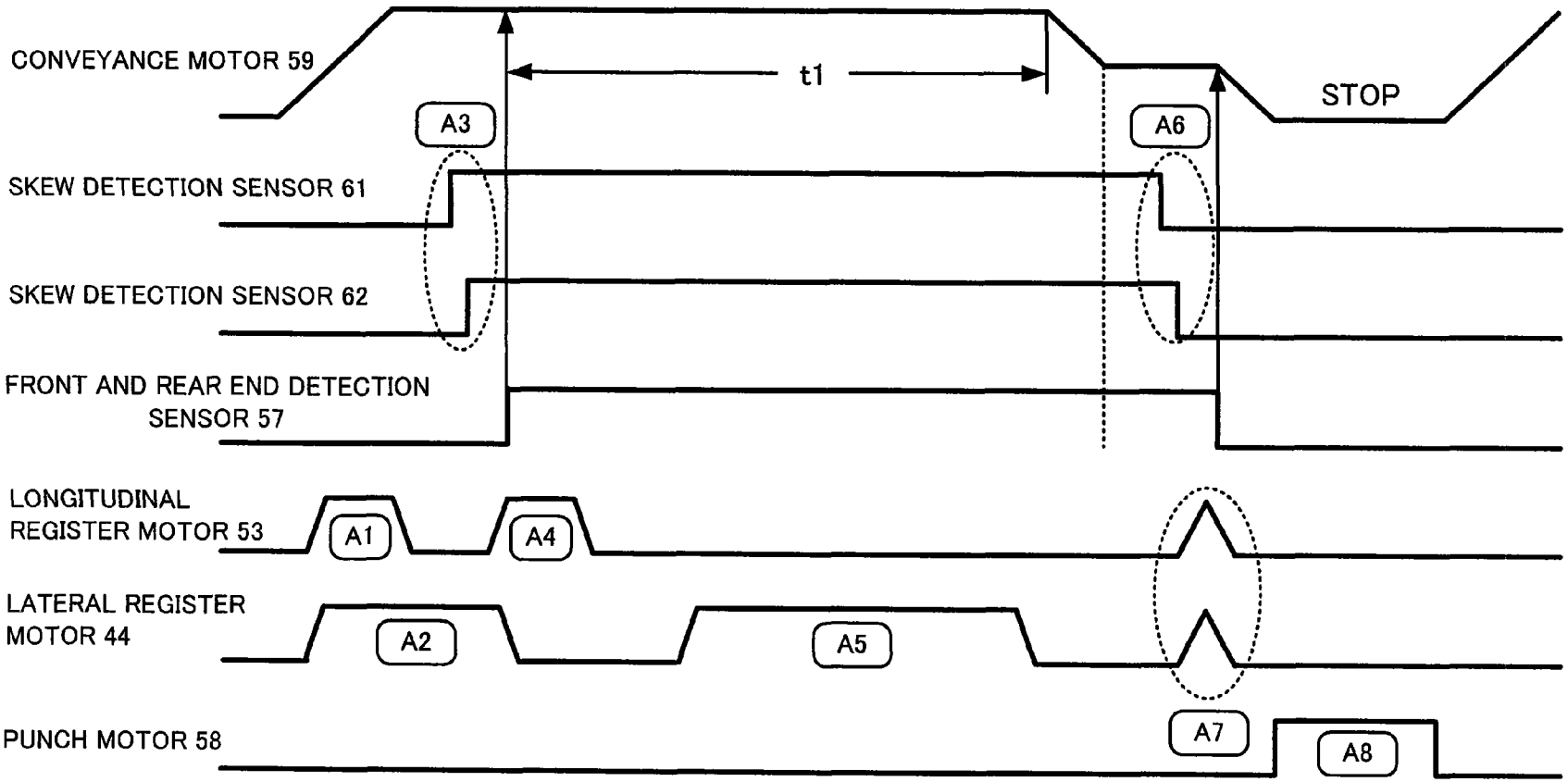
FIG. 7 is a timing chart showing the operation of the punch unit.

FIG. 7 is a timing chart for explaining the operation of the flowchart of FIG. 6. FIG. 7 shows operation timings of the conveyance motor 59, the sensors 61 and 62 for skew detection, the front end and rear end detection sensor 57, the longitudinal register motor 53, the lateral register motor 44, and the punch motor 58.

Incidentally, A1 to A8 shown in FIG. 7 correspond to Act A1 to Act A8 of the flowchart of FIG. 6, and various detections and processes are executed in the order of A1 to A8.

As is understood from FIG. 7, when the sensor 57 detects the rear end of the sheet S, a trigger is issued and the conveyance motor 59 decreases the speed at a time point when a previously set time (t1) passes, and the rotation is stopped after the speed is decreased. When the conveyance motor 59 is stopped, the punch motor 58 is driven to perform punching.

Accordingly, the punch position of the sheet S is determined by accurately setting the time t1. For example, when a stepping motor is used as the conveyance motor 59, the rotation speed of the conveyance motor 59 at the time t1, that is, the conveyance distance of the sheet S can be made constant by setting of the number of pulses, and the punch position can be set.

Next, the operation of the punching blade 36 of the puncher 35 will be described with reference to FIG. 8 and FIG. 9.

Figure 8:
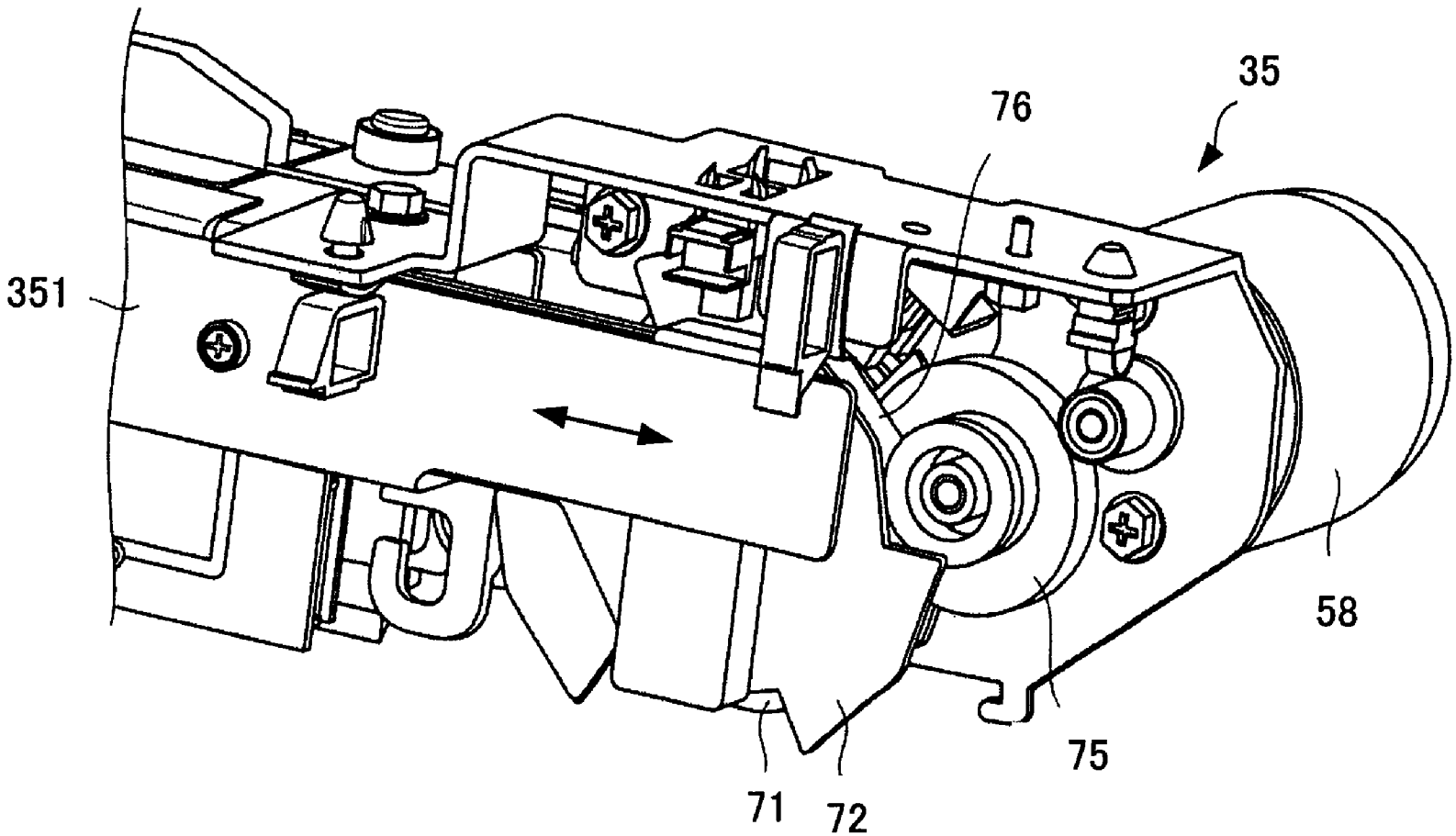
FIG. 8 is a perspective view showing a structure of a main section of the punch unit.

FIG. 8 is an enlarged perspective view showing a part of the puncher 35. The puncher 35 includes the plural punching blades 36 (see FIG. 2) for performing punching of two holes or three holes. The punching blades 36 are driven in the up-and-down direction according to the slide of a slide link 351, and the slide link 351 is driven by the punch motor 58.

Since a structure for selecting whether punching of two holes is performed or punching of three holes is performed, and a structure which drives the punching blade 36 by using the slide link 351 are generally known techniques, their detailed description will be omitted.

The puncher 35 includes a home position detection section 71 that detects the home position (standby position) of the punching blade 36, a trigger section 72 that generates triggers of the driving and stop of the punch motor 58, a gear 75, a crank gear 76 and the like.

Incidentally, the gear 75 and the crank gear 76 that transmit the rotation of the punch motor 58 to the slide link 351, and a member that drives the punching blade 36 by the slide of the slide link 351 constitute a drive mechanism. The drive mechanism drives the punching blade between a penetrate position where a punch hole is formed in the sheet and the standby position separate from the sheet.

The outline of the operation of the puncher 35 will be described. When the conveyed sheet S enters the puncher 35, the punch motor 58 alternately repeats half forward rotation and half reverse rotation, and slides the slide link 351 from side to side.

The punching blade 36 moves up and down by the slide of the slide link 351, and a punch hole is formed in the sheet S. That is, when the punch motor 58 is driven to be half rotated, first punching is performed, and when the punch motor is driven to be rotated in the reverse direction, punching is performed to a next sheet.

Incidentally, there is a puncher in which when the punch motor 58 makes one rotation, punching is performed one time. In the puncher in which the punching is performed one time when the punch motor 58 makes one rotation, the punch motor 58 rotates only in one direction, and the punch operation is repeated.

As the puncher 35, there is a unit in which the number of punch holes is changed between two and three, and punching is performed. In the unit in which the number of punch holes is changed between two and three, and the punching is performed, a mechanism is such that when the punch motor 35 is driven in a first direction, a three-hole punching blade is driven, and when the punch motor is driven in the reverse second direction, a two-hole punching blade is driven.

The example of FIG. 8 shows the puncher in which the punch motor 11 is driven to be rotated in the forward direction and reverse direction, the punching is performed, and two holes are formed.

Figure 9A:
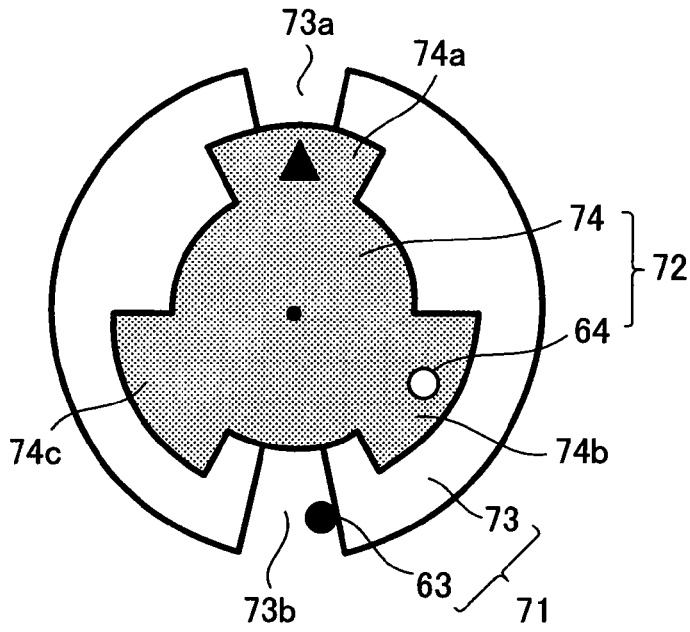
FIGS. 9A and 9B are front views for explaining a structure and an operation of a light shielding plate.

FIG. 9A is a front view showing the home position detection section 71 and the trigger section 72.

The home position detection section 71 detects whether the punching blade 36 is located at the home position. The home position of the punching blade 36 is the rising standby position separate from the sheet S. The home position detection section 71 includes a disk-like light shielding plate 73 and a photosensor 63. The light shielding plate 73 has notches 73*a* and 73*b* at positions of 180 degrees, and the photosensor 63 is disposed to sandwich the light shielding plate 73 in the up-and-down direction.

The trigger section 72 is for triggering braking or the like of the punch motor 58, and includes a disk-like light shielding plate 74 and a photosensor 64. The light shielding plate 74 includes shielding sections 74*a*, 74*b* and 74*c* at intervals of 120 degrees, and the photosensor 64 is disposed to sandwich the light shielding plate 74 in the up-and-down direction.

Incidentally, in each of the photosensors 63 and 64, although a light emitting element and a light receiving element are disposed to be opposite to each other, FIG. 9A shows only the positions of the photosensors 63 and 64.

The light shielding plates 73 and 74 rotate in synchronization with the punch motor 58. When the notch 73*a* or 73*b* of the light shielding plate 73 comes to the position of the photosensor 63, in the photosensor 63, light from the light emitting element is transmitted to the light receiving element, and when the notch 73*a* or 73*b* departs from the position of the photosensor 63, the light from the light emitting element is shielded. Accordingly, when the punch motor 58 makes a half rotation, and is reversely rotated and returns to the original position, the light is transmitted and the photosensor 63 detects the home position.

When each of the shielding sections 74*a* to 74*c* of the light shielding plate 74 comes to the position of the photosensor 64, light from the light emitting element is shielded in the photosensor 64, and when each of the shielding sections 74*a* to 74*c* departs from the position of the photosensor 64, the light from the light emitting element is transmitted to the light receiving element. The detection result of the photosensor 64 becomes a trigger signal for driving, braking, stopping or the like of the punch motor 58.

Next, the operation of the home position detection section 71 and the trigger section 72 will be described with reference to FIG. 9B.

Figure 9B:
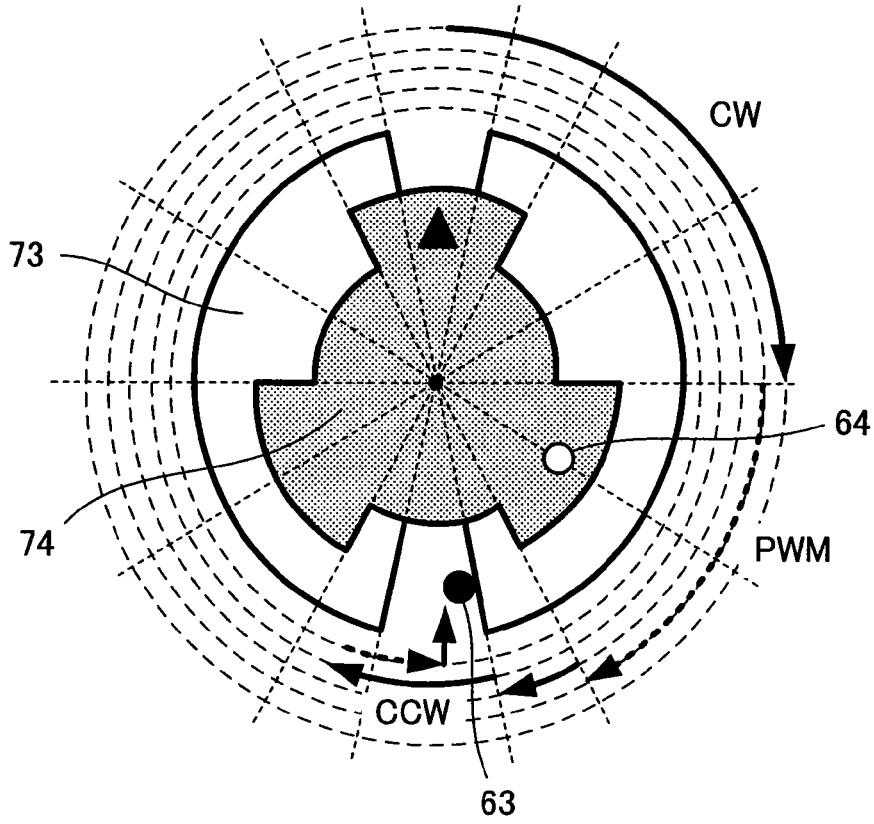

As shown in FIG. 9B, the punch motor 58 makes a half rotation for one punch operation. The light shielding plate 73 of the home position detection section 71 has the notches 73*a* and 73*b*, and distinguishes between two home positions. When the shielding section 74*a* (attached with a triangular mark) of the light shielding plate 74 is located at the upper side in the drawing, the position is defined as a first home position. When the light shielding plate 74 is rotated by 180 degrees and the shielding section 74*a* is located at the lower side, the position is defined as a second home position.

When the punch motor 58 makes a half rotation in a forward direction (CW direction), that is, in a first direction, the punching blade 36 is driven and punching is performed. When the punch motor 58 makes a half rotation in the forward direction, the light shielding plates 73 and 74 rotate from the first home position to the second home position.

When the punch motor 58 makes a half rotation in the reverse direction (second direction), next punching is performed. When the punch motor 58 makes a half rotation in the reverse direction, the light shielding plates 73 and 74 rotate from the second home position to the first home position.

Figure 10A:
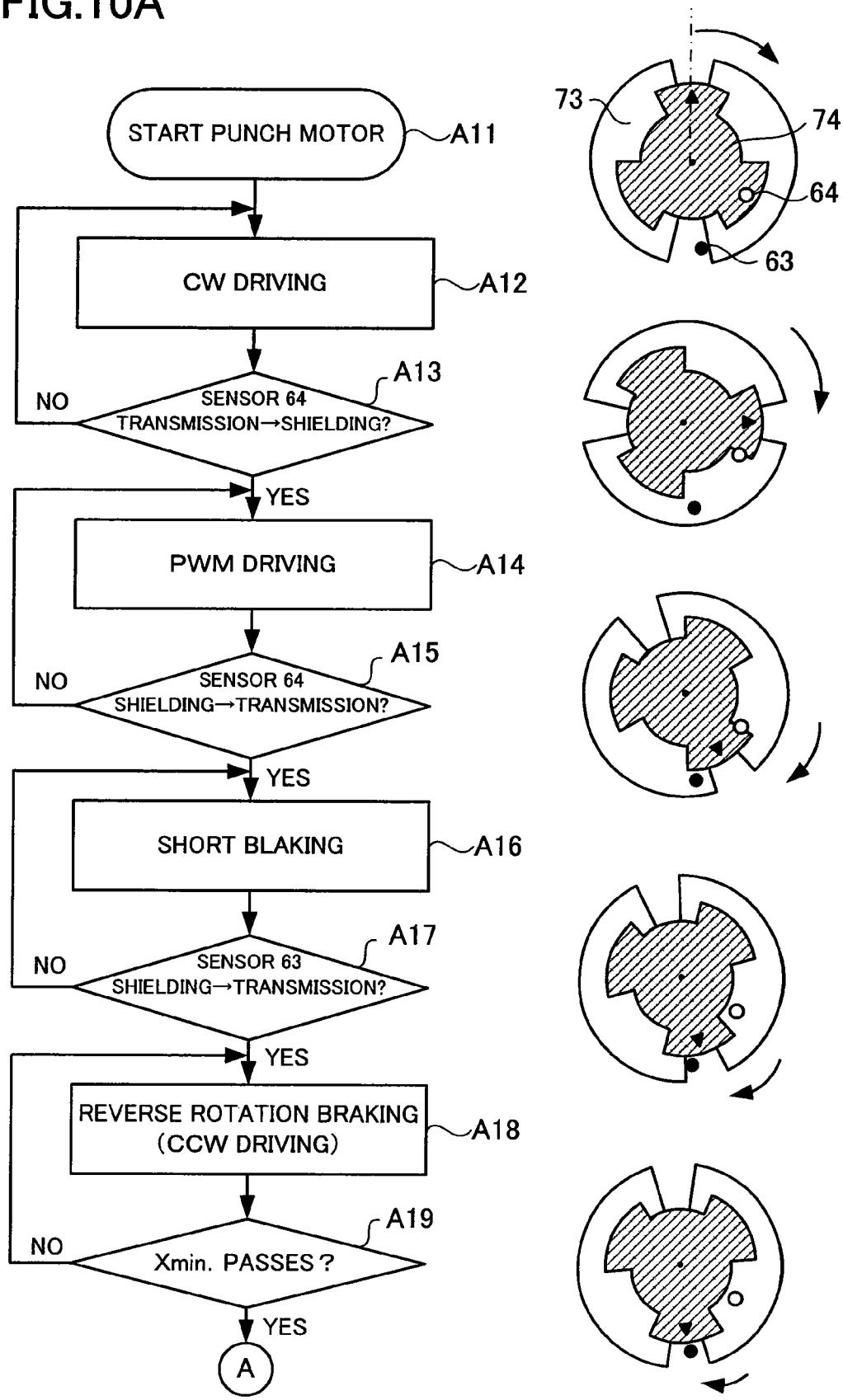
FIGS. 10A and 10B are flowcharts showing a rotation operation of a punch motor.

Hereinafter, the rotation control of the punch motor 58 will be described with reference to FIG. 9B and flowcharts of FIGS. 10A and 10B. Incidentally, in the flowcharts of FIGS. 10A and 10B, the rotation of the light shielding plates 73 and 74 is also illustrated.

First, at Act A11, driving of the punch motor 58 is started from the state where the light shielding plates 73 and 74 are located at the first home position. At Act A12, the punch motor 58 rotates in the clockwise direction (CW direction) by normal driving, and the photosensor 64 is put in a light transmission state halfway. Besides, the light shielding plate 74 rotates and when the shielding section 74*a* shields the photosensor 64, at Act A13, the photosensor 64 is changed from the light transmission state to the light shielding state, and at Act A14, the punch motor 58 is PWM driven.

In the PWM driving, the punch motor 58 is turned on and off to perform a chopping operation, and the rotation speed is decreased. After the rotation speed is dropped, the shielding section 74*a* of the light shielding plate 74 passes through the photosensor 64. At Act A15, when the photosensor 64 is changed from the light shielding state to the light transmission state, the driving of the punch motor 58 is stopped. The driving stop of the punch motor 58 is a short braking period shown at Act A16, and the punch motor 58 rotates by inertia.

At Act A17, when the notch 73*a* of the light shielding plate 73 comes to the position of the photosensor 63, the photosensor 63 is changed from the light shielding state to the light transmission state, and at Act A18, the punch motor 58 is driven in the reverse direction (CCW direction), and reverse rotation braking is applied. At Act A19, the punch motor 58 is stopped at the time point when it is determined that a time of X msec. passes, and is stopped at the second home position.

The punch motor 58 does not stop at the second home position and may overrun. Thus, after the end of the reverse rotation braking, the passage of a time of X' msec. is determined at Act A20, and then, the state of the photosensor 63 is determined at Act A21.

At Act A21, when the photosensor 63 is in the light transmission state, it is determined that the punch motor 58 is at the second home position, and driving is ended at Act A24.

On the other hand, at Act A21, when the photosensor 63 is in the light shielding state, it is determined that an overrun occurs, and at Act A22, the punch motor 58 is PWM driven in the CCW direction and is reversely rotated. At Act A23, when the punch motor 58 is stopped when the photosensor 63 is changed from the light shielding state to the light transmission state, even if the overrun occurs, the punch motor can be stopped at the second home position.

Incidentally, when the punch motor departs from the home position after the end of the reverse rotation braking, it may be stopped after passing through the home position, or may be stopped before the home position. Thus, in general, the on and off time T1 and T1' of the PWM and the elapsed time X are set so that the punch motor is stopped at a position past the home position, and after the stop, the punch motor is reversely driven and is returned to the home position.

Besides, since the shape of each of the light shielding plates 73 and 74 is axisymmetric as shown in FIG. 9A, when the punch motor is rotated in the reverse direction from the second home position to the first home position, similarly, driving in the CCW direction, PWM driving, breaking by driving in the CW direction, and stopping are performed by using the detection results of the photosensors 63 and 64.

Figures 11A, 11B, 11C, 11D, 11E, 11F:
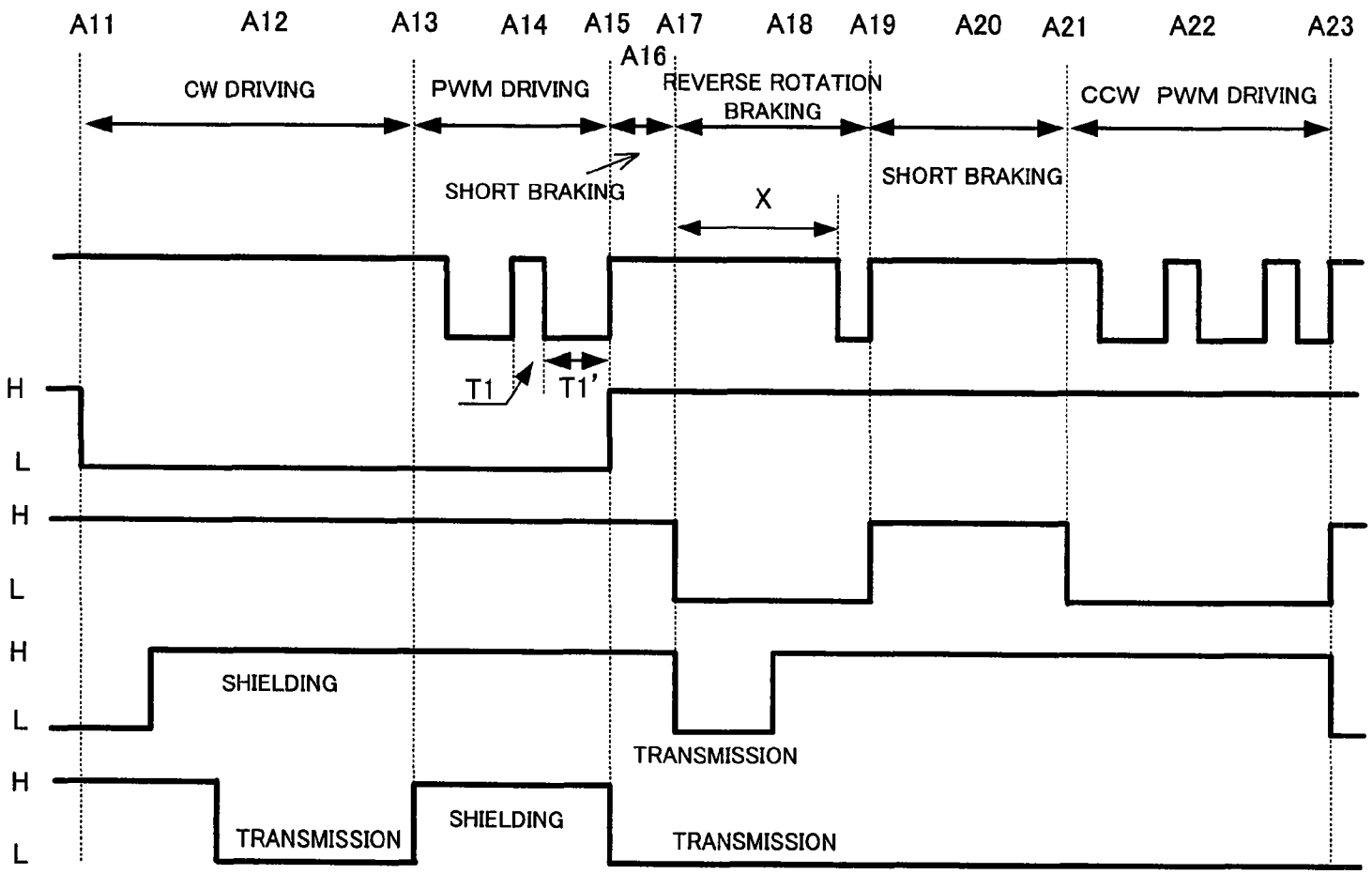
FIGS. 11A to 11F are waveform views for explaining the rotation operation of the punch motor.

FIG. 11A shows an operation mode of the punch motor 58, and corresponds to Act A11 to A23. FIG. 11B shows a drive waveform of the punch motor 58. FIGS. 11C and 11D show control signals of the punch motor 58. When the waveform of FIG. 11C is at an L (Low) level, the motor rotates in the forward direction, and when the waveform of FIG. 11D is at an L level, the motor rotates in the reverse direction. Besides, when both waveforms of FIG. 11C and FIG. 11D are at H (High) level, the punch motor 58 is stopped and is in a short brake state.

FIG. 11E shows a detection output of the photosensor 63, the H (High) level represents shielding, and the L (Low) level represents transmission. FIG. 11F shows a detection output of the photosensor 64, the H (High) level represents shielding, and the L (Low) level represents transmission.

As shown in FIG. 12, since a load varies according to the thickness of the sheet and the like, the set values of the on and off time T1 and T1' of the PWM, and the elapsed time X are changed. In FIG. 12, with respect to thick paper 1 to thick paper 4, the thickness of the sheet is larger than that of standard paper, and the thickness becomes larger from thick paper 1 to thick paper 4. In the thick paper, as compared with the standard paper, the on period of the PWM driving is made long, and one clock of the PWM is made short. The time X of reverse rotation braking is made short as compared with the case of the standard paper.

In the puncher 35, the punch motor 58 is rotated in the forward direction to form a punch hole, and the punch motor 58 is rotated in the reverse direction to form a punch hole. However, since the load at the forward driving and the load at the reverse driving are different from each other, an error occurs when the punching blade 36 is stopped at the home position.

In a first embodiment, when the punch motor 58 is driven, the load at the rotation in the forward direction and the load at the rotation in the reverse direction are measured, and the drive waveform of the PWM is corrected according to the load.

The measurement of the load of the punch motor 58 is performed before the sheet S is ejected from the image forming apparatus 10, that is, in a state where there is no sheet. Besides, the measurement is performed in low speed driving of PWM driving.

That is, the correction of the drive waveform based on the measurement of the load is performed while the punch motor 58 is PWM driven from the first home position to the second home position. For example, as shown in FIG. 13A, the correction is performed in the low speed driving by the chopping operation in which ON of T2 msec. and OFF of T2' msec. are repeated.

The number of times of ON or OFF when the PWM driving is performed is measured and stored. When punching is performed, when the measurement value is different from a previously set specified value, a difference is calculated, and the ON period T1 and the OFF period T1' at the PWM driving (A14) shown in FIG. 11A are corrected. Alternately, X (msec.) as the reverse rotation braking time is corrected.

For example, as shown in FIG. 13A, it is assumed that the specified value for the measurement value of the ON period is 8. When the load is normal, driving can be performed from the first home position to the second home position through eight ON periods. As in FIG. 13B, when the measurement value of the ON period is 10, it is understood that the load is large as compared with the original load.

FIG. 14A shows a PWM drive waveform when the load is normal, and the ON period is denoted by T1, and the OFF period is denoted by T1'.

When the load is large, as shown in FIG. 14B, the PWM drive waveform is corrected, and the ON period is increased to T11, and the OFF period is decreased to T11'. Alternatively, correction is performed to decrease X (msec.) as the reverse rotation braking time. By the correction, the drive torque is made larger than normal, or breaking weaker than usual is applied, so that even if the load becomes large, the punch motor can be accurately driven to the specified position.

On the other hand, by the characteristic of the punch motor 58 or the individual difference of a punching section of the puncher 35, the torque and load of the punch motor 58 at the rotation in the forward direction can be different from those at the rotation in the reverse direction. For example, there is a case where the torque is high at the forward rotation, the torque is low at the reverse rotation, and a difference between the torque at the forward rotation and that at the reverse rotation is large.

When the torque is high at the forward rotation and the torque is low at the reverse rotation, since the load caused when the punch motor is driven in the forward direction is low, the PWM drive waveform is corrected so that the ON period is short, and the time of braking is set to be long. However, when the punch motor 58 is driven in the reverse direction, the torque is insufficient, and the punch motor becomes liable to be stopped, and stops before the home position.

Besides, when the PWM drive waveform or the braking time is corrected based on the measurement value of the load caused when driving is performed in the reverse direction, the punch motor cannot be stopped at the position of the home position, and significantly overruns.

In order to deal with the torque difference between the forward rotation of the punch motor 58 and the reverse rotation thereof, in the first embodiment, the punch motor 58 is driven in the forward direction and the reverse direction, the measurement values of the load at the forward rotation and the load at the reverse rotation are stored in a memory, and the drive waveform of the PWM and the time of the reverse rotation braking are corrected based on the stored measurement values.

Besides, in the driving of the punch unit 30, since the load is changed by the variation of voltage or the like, it is necessary to measure the load at regular time intervals. However, the error of the load in the forward direction and the reverse direction is not changed as long as the environment such as low temperature and low humidity is not changed.

Accordingly, only at the first initialization driving (initial mode) after power is turned on, the loads in the forward direction and the reverse direction (both directions) are measured, and the drive waveform of the PWM and the braking time are corrected.

Hereinafter, until the power is turned off, the load only in one direction of the forward direction and the reverse direction is measured. Based on the measured result, the correction on the one direction is performed.

With respect to the other remaining direction, the correction value obtained by the measurement in both directions is added to the correction value of the one direction, and the drive waveform of the PWM and the braking time are corrected. Accordingly, the measurement time of the load can be shortened, and power saving becomes possible.

That is, in the initial mode after the power is turned on, the difference between the loads obtained when the punch motor 58 is rotated in both directions and the measurement is performed is calculated, and the difference information is stored in the storage section (memory). Until the power is turned off, the correction value is calculated based on the load obtained when the motor is rotated in the one direction and the measurement is performed. With respect to the other remaining direction, the difference read from the storage section is added to the load measured in the one direction, and the correction value is calculated based on the added value.

FIG. 15 shows the measurement timing of the load of the punch motor 58. That is, when the power is turned on and the punch motor 58 is not driven at all, the punch motor 58 is initialized and driven to be rotated in the forward direction and the reverse direction, and the loads in both directions are measured.

At another initialization driving after the power is turned on, for example, at the initialization driving after sheet jamming (jam) occurs, the punch motor 58 is driven only in one direction of the forward direction and the reverse direction, and the load in the one direction is measured. Besides, even when the sheet S is supplied and the job is started, the punch motor 58 is driven only in one direction of the forward direction and the reverse direction, and the load in the one direction is measured.

Figure 16:
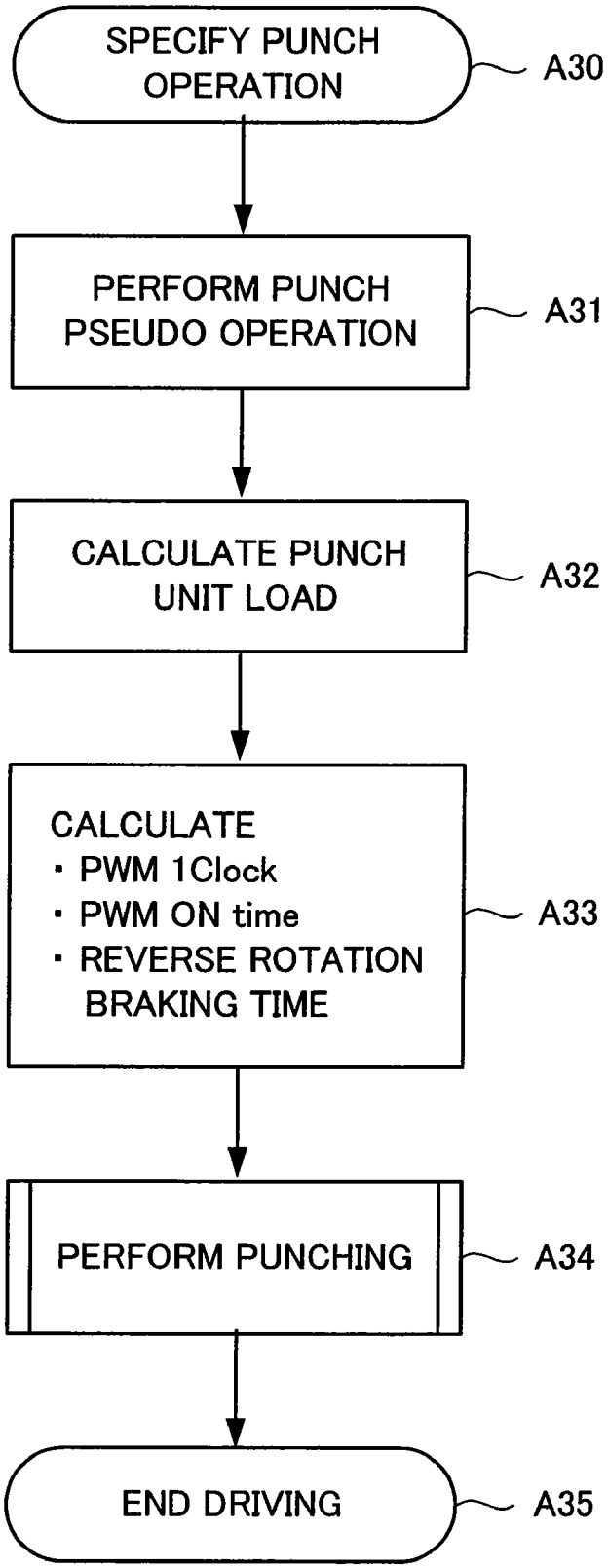
FIG. 16 is a flowchart showing the measurement of the load of the punch motor and a drive process.

FIG. 16 is a flowchart for explaining the measurement of the load of the punch motor 58 and the operation of driving of the punch motor 58.

First, at Act A30, a punch operation is specified. That is, since it takes time before an image is formed on the sheet S in the image forming apparatus 10 and is conveyed to the finisher 20, the time taken before the sheet reaches the finisher 20 is used, and it is specified to rotate the punch motor 58 from the first home position to the second home position. Incidentally, at the initial time after the power is turned on, it is specified to rotate the punch motor in both directions, that is, from the first home position to the second home position and from the second home position to the first home position.

At Act A31, in a state where there is no sheet S, the punching blade 36 is moved up and down, and a pseudo operation of punching is performed. At Act A32, the load obtained when the punch motor 58 is rotated in both directions or one direction is calculated.

At Act A33, one clock period and ON period of the PWM waveform of the punch motor 58 are calculated based on the calculation result of the load. Alternatively, the reverse rotation braking time is calculated. When the load varies, the one clock period and the ON period of the PWM waveform, or the reverse rotation braking time is corrected. At Act A34, the sheet S is actually supplied and punching is performed, and at Act A35, the driving of the punch motor 58 is ended.

In the first embodiment, even when the load in the case where the punch motor 58 is forwardly rotated and the load in the case where it is reversely rotated are different due to the individual difference of the punch motor 58, the change of the environment and the like, the punch motor can be accurately stopped at the home position after punching is performed.

Incidentally, the control section 201 of FIG. 3 constitutes a drive control section that controls the punch motor by using the position information of the punching blade 36 detected by the home position detection section 71 and stops the punching blade 36 at the standby position (home position).

The control section 201 constitutes a correction control section that measures the first load of the punch motor 38 at the rotation in the forward direction and the second load of the punch motor 38 at the rotation in the reverse direction before the sheet S is supplied from the image forming apparatus 10, and corrects the drive amount of the punch motor 38 after the sheet S is supplied from the image forming apparatus 10 according to the first load and the second load.

Next, the finisher 20 of a second embodiment will be described.

The second embodiment deals with the temperature rise of the punch unit 30 when punching is continuously performed to a large number of sheets.

Figure 10B:
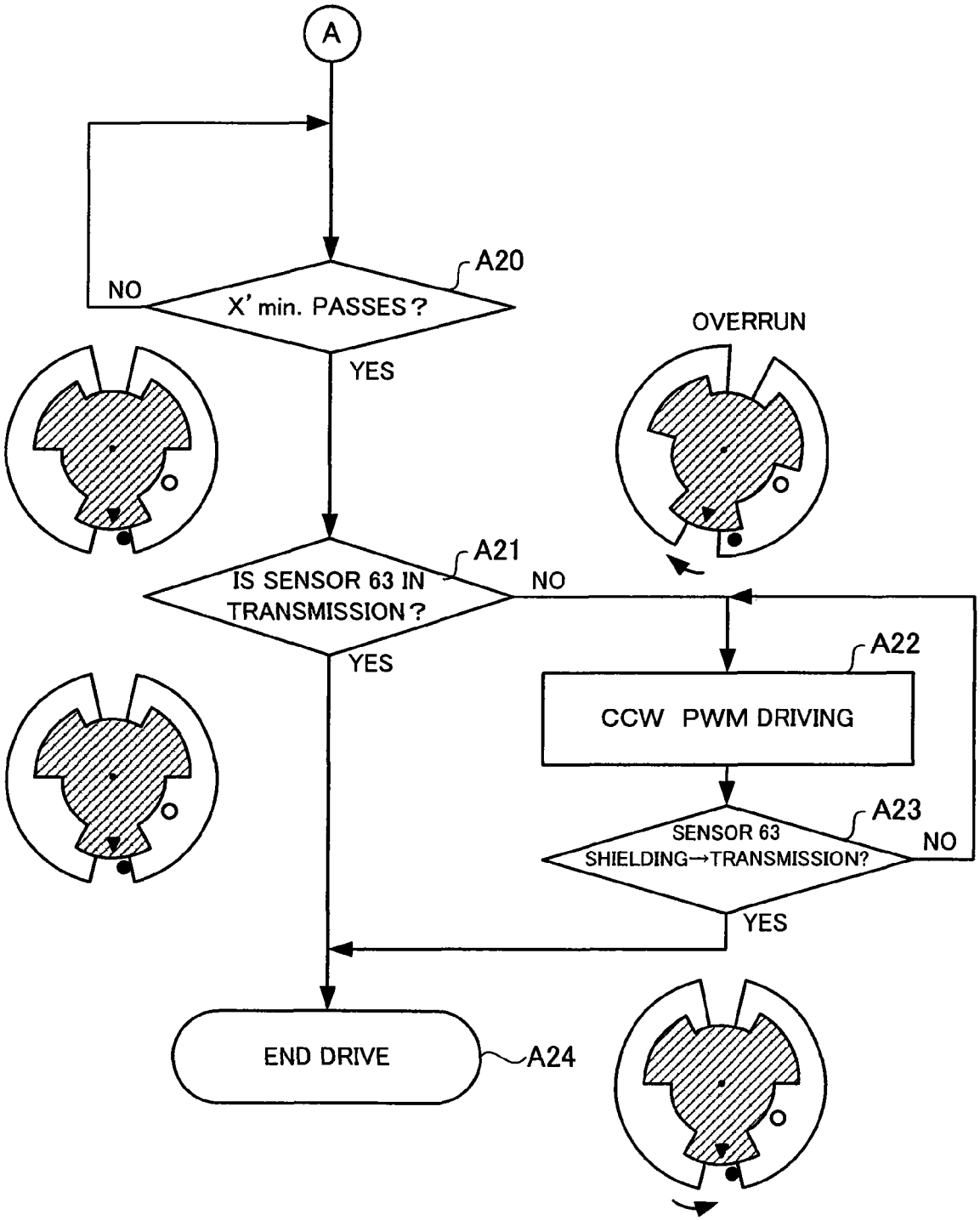

That is, at Act A21 to A24 of the flowchart of FIG. 10B, when it is determined at Act A21 that the photosensor 63 is in the light transmission state, it is determined that the punch motor 58 is located at the home position, and the driving is ended. Besides, at Act A21, when the photosensor 63 is in the light shielding state after the reverse rotation braking is ended, it is determined that the punch motor departs from the home position. However, it is impossible to determine whether the punch motor stops at a position where it overruns the home position or stops before the home position.

Accordingly, in general, the on and off time (T1, T1') of the PWM driving and the elapsed time X are set to provide such control that the punch motor is rotated to a position past the home position and is stopped, and after the stop, it is reversely driven and is returned to the home position.

However, when punching is continuously performed to a large number of sheets, even if the overrun occurs at the start of the punching at Act A21 (NO) of FIG. 10B, when the punching is continued, the temperature of the punch unit 30 rises, and the load of the punching operation increases, and accordingly, the overrun does not occur.

Figure 17A:
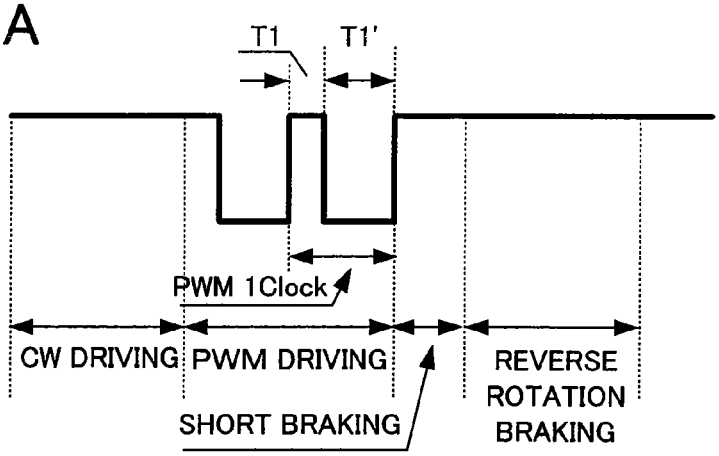
FIGS. 17A and 17B are waveform views showing the initial drive waveform of the punch motor.
Figure 17B:
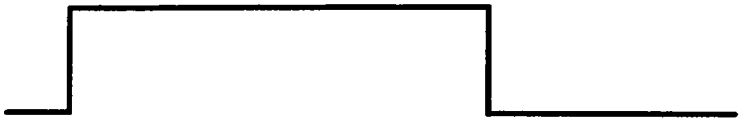

FIG. 17A shows a PWM drive waveform of the punch motor 58 at the start of punching, and FIG. 17B shows a detection output of the photosensor 63. However, when the punching is continued, since the load of the punch unit 30 increases, the overrun does not occur.

Figure 18A:
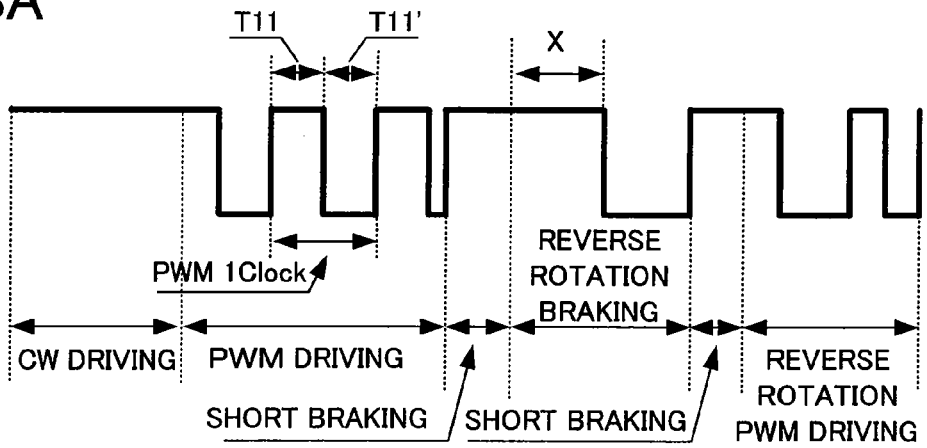
FIGS. 18A and 18B are waveform views showing the drive waveform of the punch motor when punching is continuously performed.

In the second embodiment, the overrun amount of the punch motor 58 is measured, and when the photosensor 63 does not detect light transmission at Act A21 of FIG. 10B, and the overrun does not occur, as shown in FIG. 18A, the PWM drive waveform is corrected in punching to subsequent sheets.

Figure 18B:
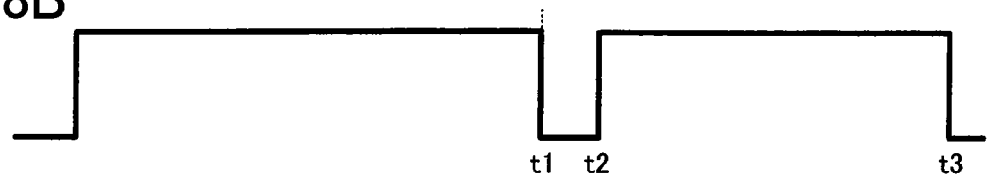

That is, as shown in FIG. 18A, the PWM drive waveform of the punch motor 58 is corrected, the ON period of the chopping operation is increased from T1 to T11 (msec.), and the OFF period is decreased from T1' to T11' (msec.). Alternatively, the reverse rotation braking time is shortened. FIG. 18B shows the detection output of the photosensor 63 when the PWM drive waveform is corrected.

When the load increases, the overrun occurs by correcting the PWM waveform or the reverse rotation braking time. A period (t1 to t2) of FIG. 18B indicates that the detection output of the photosensor 63 is once changed to that in the light transmission state by the overrun and is changed to that in the light shielding state. After the overrun, the punch motor 58 is stopped by the reverse rotation braking, and is returned by the PWM driving in the CCW direction. The photosensor 63 is changed from the light shielding state to the light transmission state at timing t3, so that the punch motor 58 is stopped at the home position.

Accordingly, even if punching is continuously performed to a large number of sheets, the temperature of the punch unit 30 rises and the load increases, the punch motor can be normally stopped at the home position, and next punching can be accurately performed.

Next, a third embodiment will be described.

The third embodiment relates to a handling method to a case where when the punching blade 36 is stopped by an error or the like during punching, a sheet is torn when the sheet is removed, and a torn piece of the sheet remains on a drive path of the punching blade 36.

That is, at initialization of a mechanism on power-up or the like, when the punching blade 36 is not located at the home position, idle punching is performed, the punch motor 58 is PWM driven in the state where there is no sheet, and the punching blade 36 is returned to the home position.

When the punching blade 36 is located at the home position, idle punching is not performed. This is because, when the idle punching is indiscriminately performed, there occurs such a problem that the durability is influenced, or the operation sound is noisy.

Besides, at the initialization of the mechanism, there is a case where the load of the punch motor 58 is measured. At the time of the measurement of the load, since the punching blade 36 is returned from a position other than the home position to the home position and is accurately stopped, the punching blade is driven by a lower force than usual.

Figure 19A:
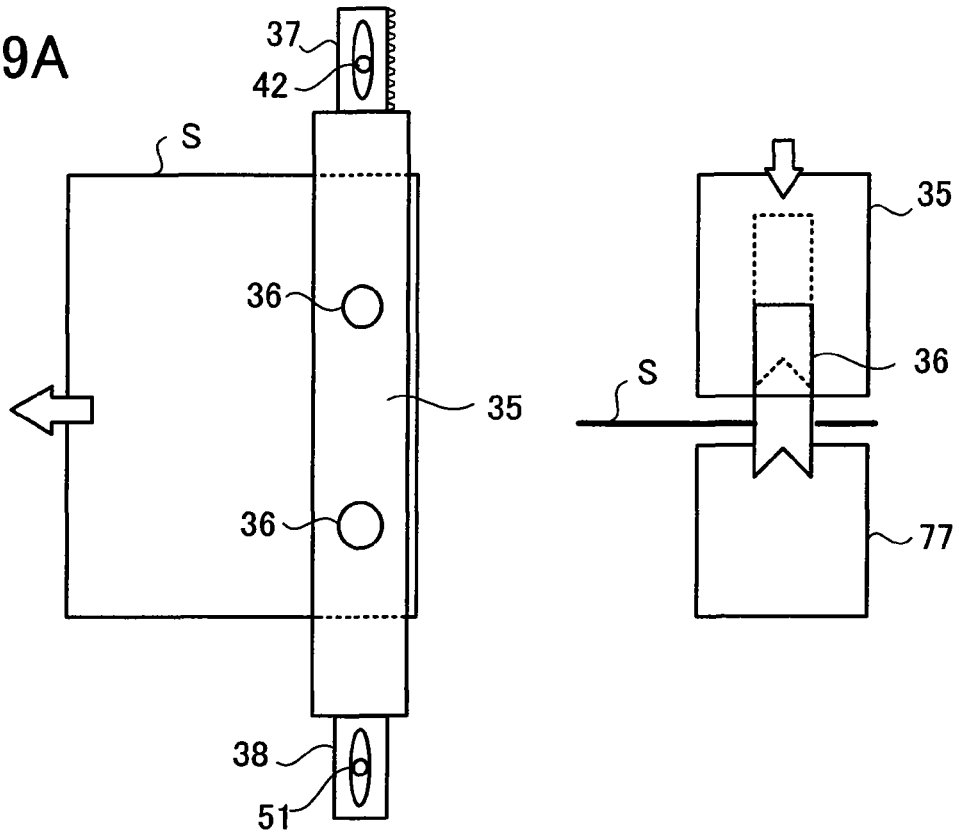
FIGS. 19A and 19B are explanatory views showing production of a torn piece of the sheet in the punch unit.

FIG. 19A shows a state where the punching blade 36 is stopped by an error or the like in a state where the punching blade 36 is driven into the sheet S. The left of FIG. 19A is a plan view, and the right is a side view, and a die 77 is provided to be opposite to the puncher 35.

Figure 19B:
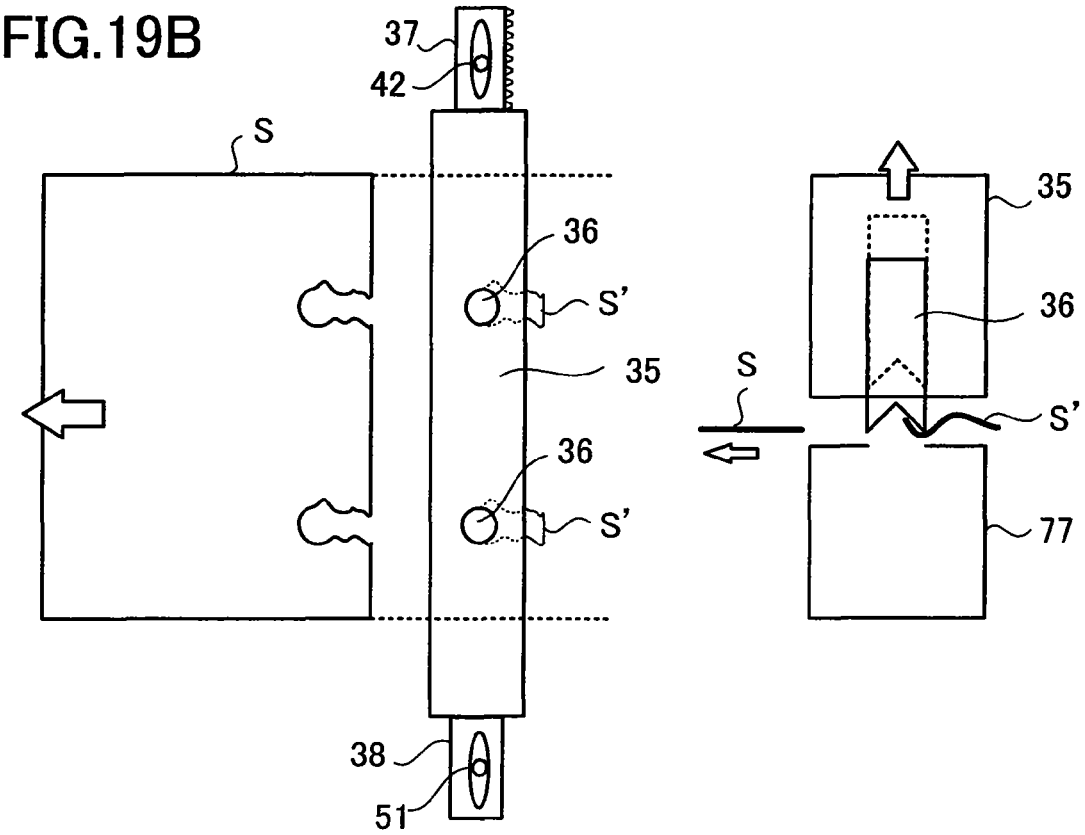

When the sheet S is forcibly pulled and removed in the state where the punching blade 36 is stopped, as shown in FIG. 19B, the sheet S is torn, and a torn piece of the sheet S' may remain on the drive path of the punching blade 36. Besides, as shown in FIG. 19B, the torn piece of the sheet S' is caught by the punching blade 36 and driving cannot be performed. In the state where the torn piece of the sheet S' is caught by the punching blade 36, there is a case where even if idle punching is performed to attempt to return the punching blade to the home position, it cannot be returned.

In the third embodiment, when the punch motor 58 is stopped, it is detected whether the punch motor is stopped outside the home position or is stopped at the home position, and the detection result is stored in a storage section (not shown).

In the initialization of a mechanism at the start of a next job or the like, the detection result stored in the storage section is read, and when the punching blade 36 is stopped outside the home position, normal punching is performed at least once. That is, the punching is performed by a higher power than that in the PWM driving, so that the torn piece of the sheet S' caught by the punching blade 36 is driven into the die 77, and is removed from the drive path of the punching blade 36.

Besides, there is a case where the load of the punch motor 58 is measured, and the drive waveform is corrected. Also at the measurement of the load, similarly, the detection result stored in the storage section is read, and when the punching blade 36 is stopped outside the home position, punching is performed by a higher power than that in the PWM driving, and the torn piece of the sheet S' caught by the punching blade 36 is removed.

In the third embodiment, the state where the torn piece of the sheet S' remains on the punching blade 36 and the punching blade 36 cannot be returned to the home position can be resolved.

Next, a fourth embodiment will be described.

In the fourth embodiment, a saddle unit 80 for folding the sheet S in half is provided. Besides, a creasing unit 90 for creasing a sheet S is provided, and even when the sheet S is skewed, a crease is formed correspondingly to the skew by using a movement mechanism 301 and a posture control mechanism 302 of a puncher 35.

Figure 20:
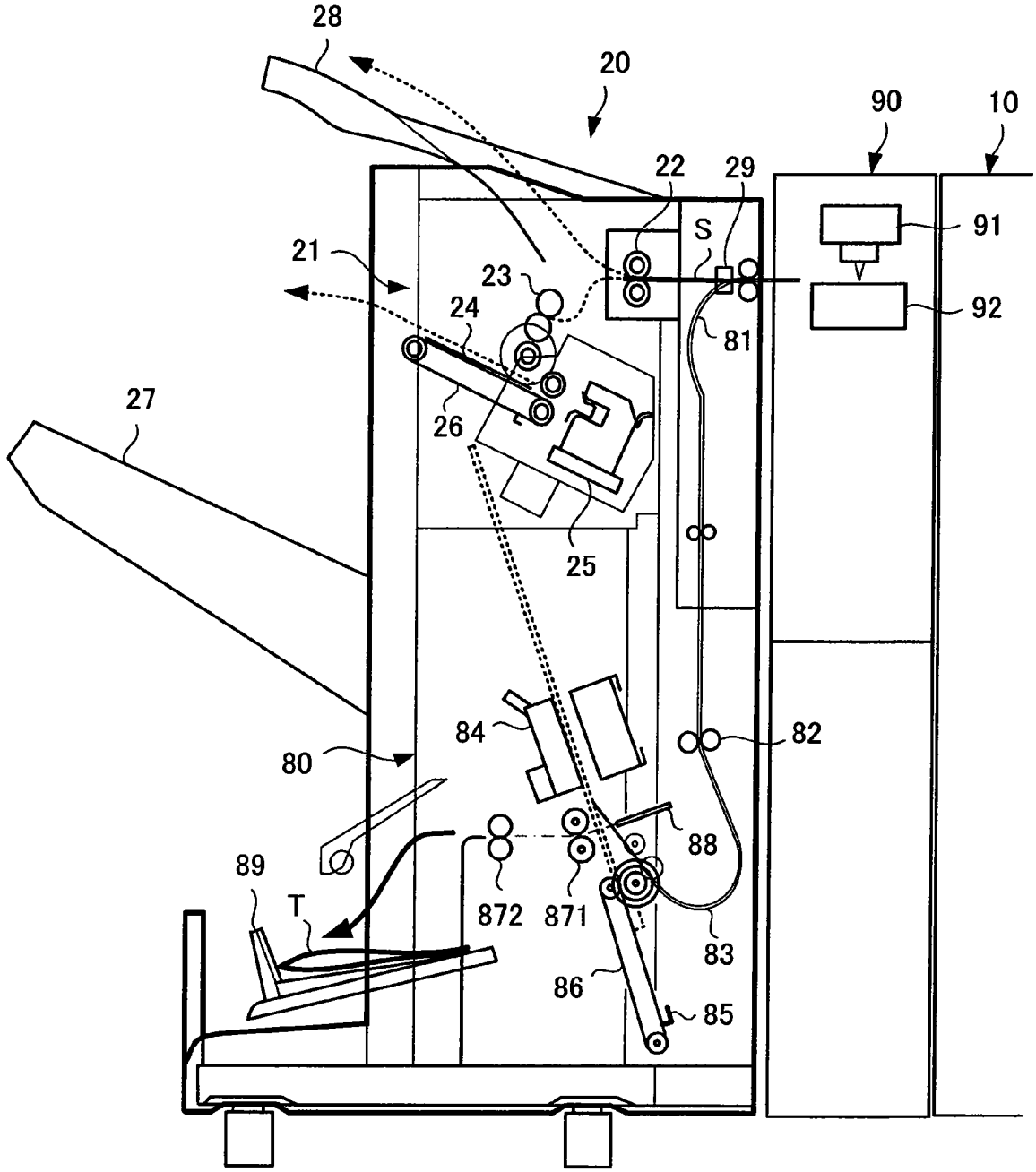
FIG. 20 is a side view showing a sheet finishing apparatus including a creasing unit and a saddle unit.

FIG. 20 is a side view showing a structure of a staple unit 21, the saddle unit 80 and the creasing unit 90 of a finisher 20.

Since the staple unit 21 has the same structure as that of FIG. 1, its description will be omitted. However, a gate 29 is provided at the front stage of an inlet roller 22. The gate 29 changes a path to convey the sheet S supplied from the creasing unit 90 to the staple unit 21 side or the saddle 80 side.

The saddle unit 80 is disposed downstream of the creasing unit 90, and bundles plural sheets on each of which a crease is formed by the creasing unit 90, and folds them in half. That is, the sheet S ejected from the creasing unit 90 is conveyed by a roller 82 through a paper path 81. The roller 82 conveys the sheet S in the direction of a stapler 84 through a paper path 83. The sheet S is once received on a stack tray 85 before the stapler 84. The sheet S is sequentially stacked on the stack tray 85 and a sheet bundle T is formed.

The sheet bundle T on the stack tray 85 is conveyed in the direction of the stapler 84 by a guide belt 86, and when the center of the sheet bundle T reaches the stapler 84, the guide belt 86 is once stopped, and the stapler 84 staples the center of the sheet bundle T.

The stapled sheet bundle T is moved down by the guide belt 86, and when the center of the sheet bundle T reaches a nip point of a pair of folding rollers 871, the sheet bundle is stopped. A blade 88 is disposed at a position opposite to the pair of folding rollers 871.

The blade 88 presses the center of the sheet bundle T to the nip point of the pair of folding rollers 871, and pushes the sheet bundle T into between the pair of folding rollers 871. The pair of folding rollers 871 rotates while folding and nipping the sheet bundle T, and folds the sheet bundle T in half. The sheet bundle T folded in half is tightly folded by a pair of ejecting rollers 872 and is ejected to a storage tray 89.

In the saddle unit 80, although the sheet bundle T is folded in half and is ejected, there is a defect that when creasing is not sufficient, the thickness of a brochure becomes large. Thus, the creasing unit 90 is provided at the front stage of the saddle unit 80. The creasing unit 90 forms a crease, for example, perforations on the sheet S ejected from the image forming apparatus 10, and conveys it to the saddle unit 80.

Figure 21:
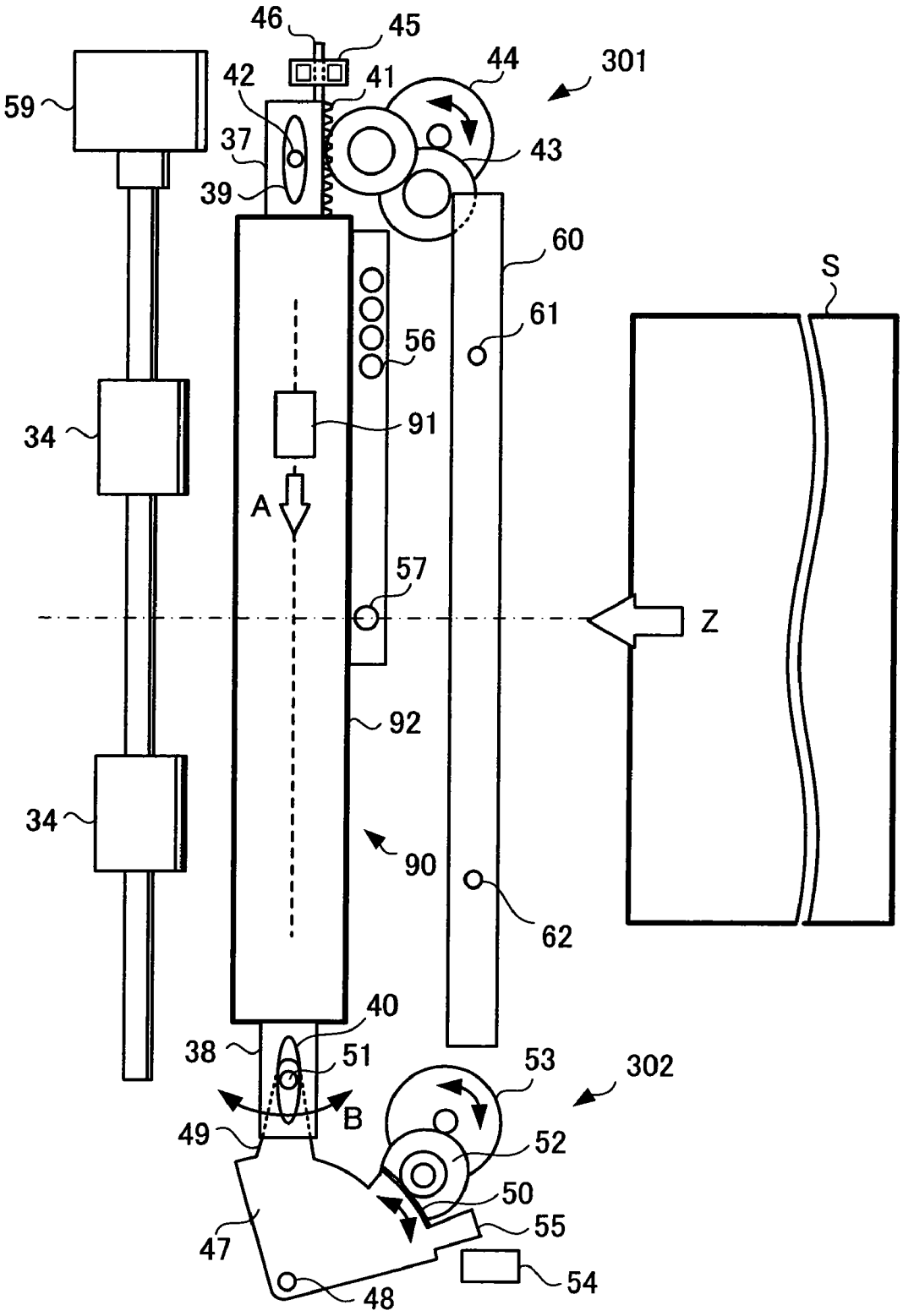
FIG. 21 is a plan view of the creasing unit.

FIG. 21 is a plan view showing a structure of the creasing unit 90.

The creasing unit 90 includes a scratch unit 91 and a pad 92. The pad. 92 is orthogonal to a conveyance direction of the sheet S. The scratch unit 91 is moved in parallel to the pad 92. The scratch unit 91 includes a needle drive section (described later), and the needle drive section drives a needle into the sheet S and forms perforations.

The movement mechanism 301 and the posture control mechanism 302 used in the punch unit 30 of FIG. 2 are attached to both ends of the pad 92. Besides, a sensor group 56 that detects a lateral end of the sheet S and a sensor 57 that detects an end (front end and rear end) of the sheet S in the longitudinal direction are provided at the sheet S carrying-in side of the pad 92. Besides, a skew detection section 60 including sensors 61 and 62 is provided.

Since the detection of the skew of the sheet S, and the detection of the lateral end, the front end and the rear end thereof are the same as FIG. 2, their description will be omitted. However, in the creasing unit 90, the front end of the sheet S is detected, the sheet S is conveyed by a previously set distance, and when the center of the sheet S is located above the pad 92, the conveyance is stopped. Then, while moving in the arrow A direction, the scratch unit 91 drives the needle into the sheet S and forms the perforations.

Figure 22:
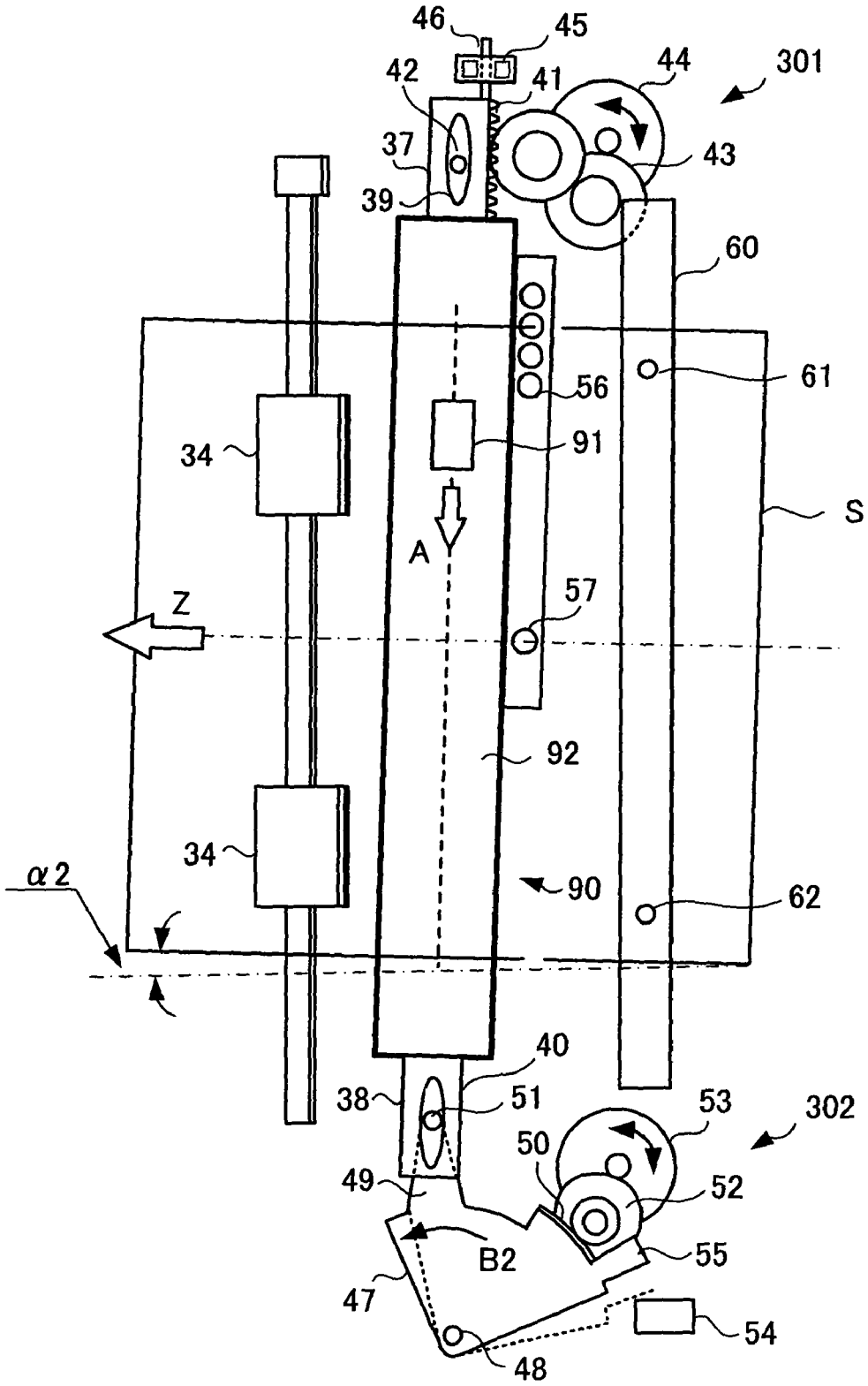
FIG. 22 is an operation explanatory view of the creasing unit.

When the sheet S is skewed, as shown in FIG. 22, an angle of the pad 92 is changed according to an angle $\alpha 2$ of the skew, and the scratch unit 91 is moved in parallel to the pad 92. The skew correction is performed based on the detection result of the skew detection section 60, and the posture control mechanism 302 controls the angle of the pad 92. Besides, when the size of the sheet S is changed, the lateral end detection sensor group 56 detects the size, and the movement range of the scratch unit 91 is controlled according to the sheet size.

Figure 23:
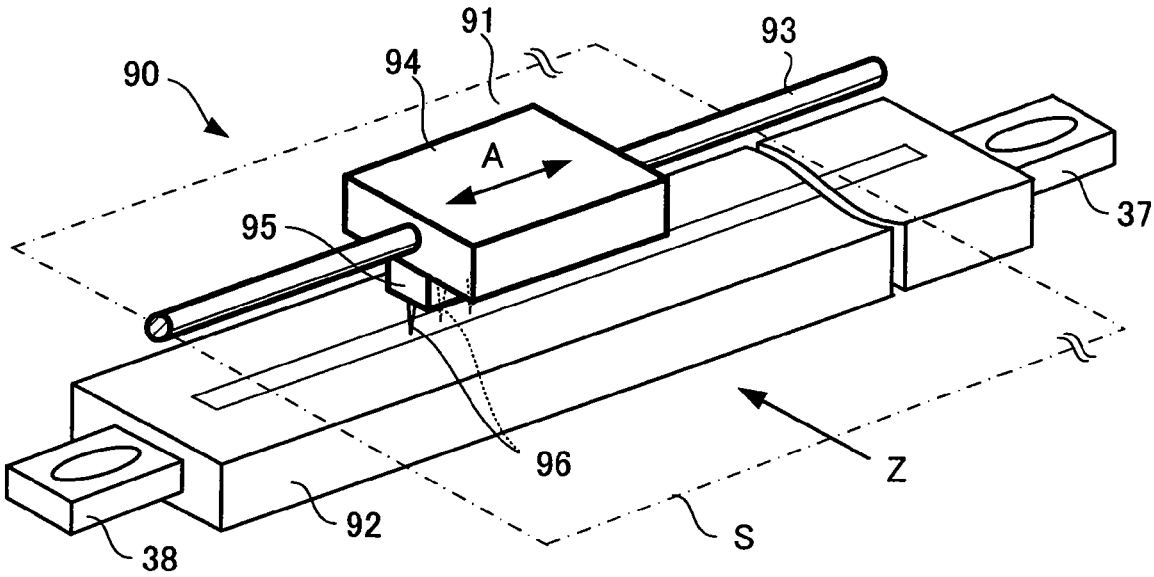
FIG. 23 is a perspective view showing a structure of the creasing unit.

FIG. 23 is a perspective view showing a structure of the creasing unit 90. The scratch unit 91 of the creasing unit 90 is disposed to be orthogonal to the conveyance direction Z of the sheet S, and includes a feed screw 93 provided in parallel to the pad 92, a moving body 94 attached to the feed screw 93, and a needle drive section 95 attached to the moving body 94.

The moving body 94 is moved in the arrow A direction by the rotation of the feed screw 93. Incidentally, although a drive section is provided to rotate the feed screw 93, its illustration is omitted. The pad 92 is disposed in parallel to the movement direction of the moving body 94, and is opposite to the needle drive section 95. The needle drive section 95 is provided with plural needles 96. When the moving body 94 is moved, the needles 96 protrude in the direction of the pad 92, and the perforations are formed in the sheet S by the needles 96.

Incidentally, although the feed screw 93 is used in order to move the moving body 94, another movement mechanism may be used in addition to the feed screw 93.

Figure 24A:
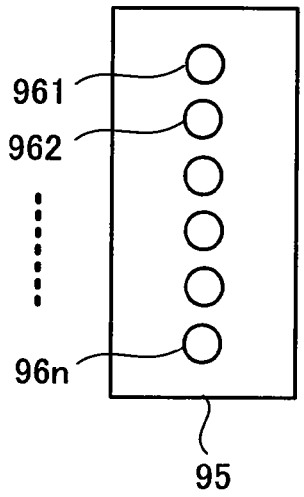
FIGS. 24A and 24B are plan views each showing an example of a needle drive section of the creasing unit.

FIG. 24A shows an arrangement of the plural needles 96 (961, 962, . . . , 96*n*) provided in the needle drive section 95. As the moving body 94 is moved, the needles 961, 961, . . . , 96*n* are sequentially projected in the direction of the pad 91 and are retracted. The needles 961, 961, . . . , 96*n* repeat the projection and retraction, so that the perforations in one line are formed in the sheet S.

Figure 24B:
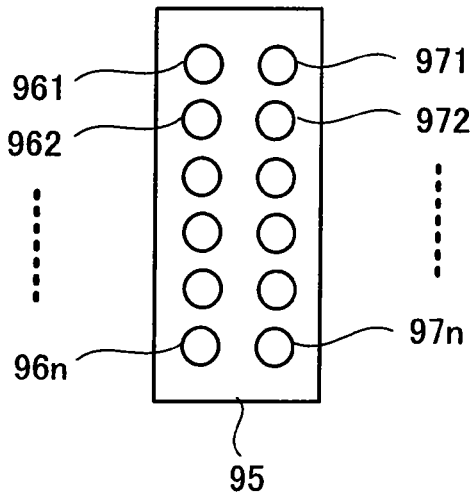

FIG. 24B is a view showing another example of needles of the needle drive section 95. The needle drive section 95 includes plural needles 96 and 97 (961, 962, . . . , 96*n*, 971, 972, . . . , 97*n*) disposed in plural lines (for example, two lines). The needle drive section 95 alternately switches between the needles 96 and 97 that form the perforations in the sheet S. By switching between the needles 96 and 97, the life of the needle can be prolonged. Incidentally, it is necessary that the stop position of the sheet S when the needle 96 is used is shifted from the stop position when the needle 97 is used, and the perforations are formed.

Figure 25:
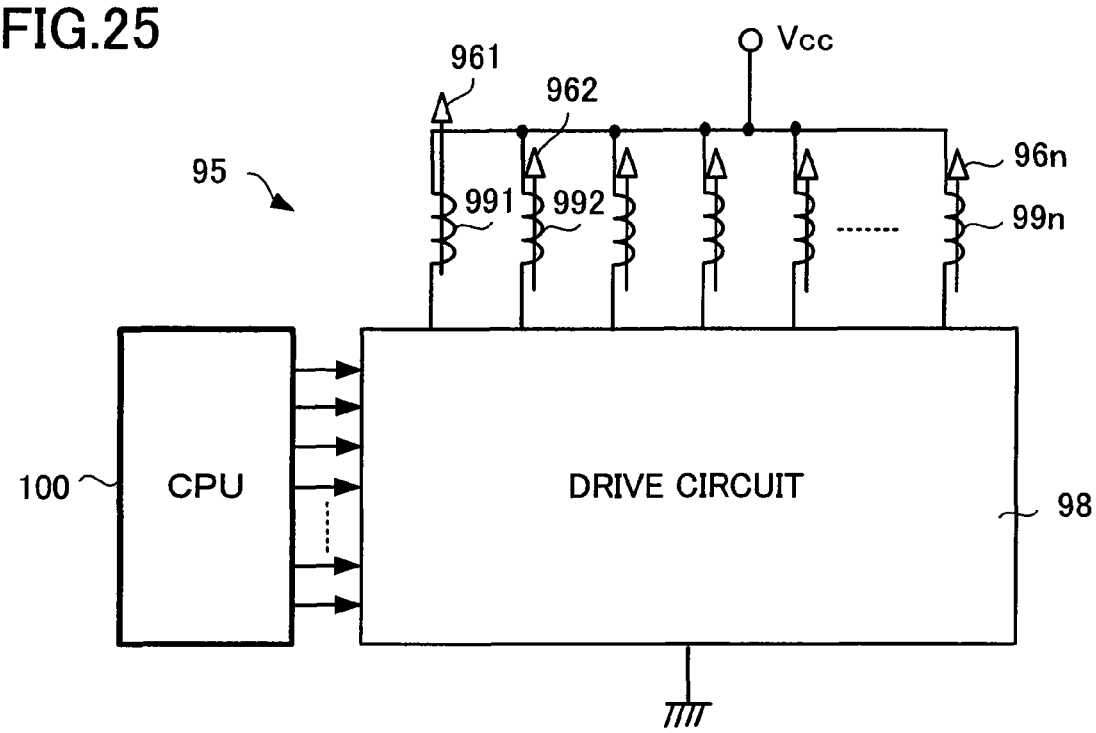
FIG. 25 is a circuit block diagram of the needle drive section.

FIG. 25 is a block diagram of the needle drive section 95. In FIG. 25, a drive circuit 98 controls the projection of the needles 961, 962, . . . , 96*n*. The drive circuit 98 is connected with coils 99 (991, 992, . . . , 99*n*). The needles 961, 962, . . . , 96*n* are projected or retracted by current flowing through the coils 991 to 99*n*.

Figure 26:
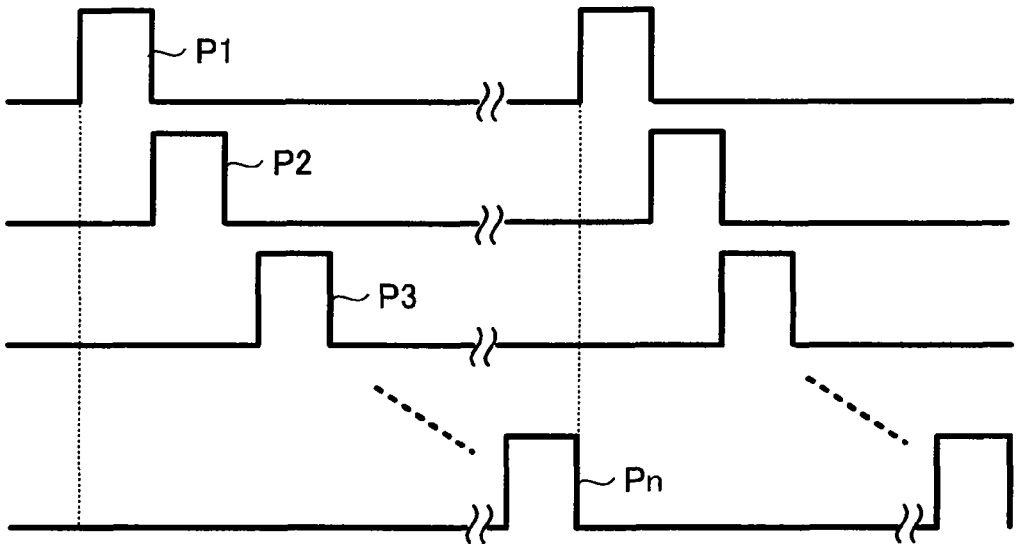
FIG. 26 is a waveform view showing drive pulses of the needle drive section.

Besides, a CPU 100 that controls the drive circuit 98 is included. The CPU 100 sequentially supplies a drive pulse to the drive circuit 98 in order to sequentially control the current flowing through the coils 991 to 99*n*. FIG. 26 shows waveforms of drive pulses P1, P2, . . . , Pn to drive the coils 991 to 99*n*.

The CPU 100 varies the amount of current flowing through the coils 991 to 99*n*, so that the perforations are intensely opened or lightly opened. For example, the current flowing through the coils 99 is changed according to the thickness of the conveyed sheet S, and the perforations are intensely opened for the thick paper and are lightly opened for the thin paper.

Figure 27:
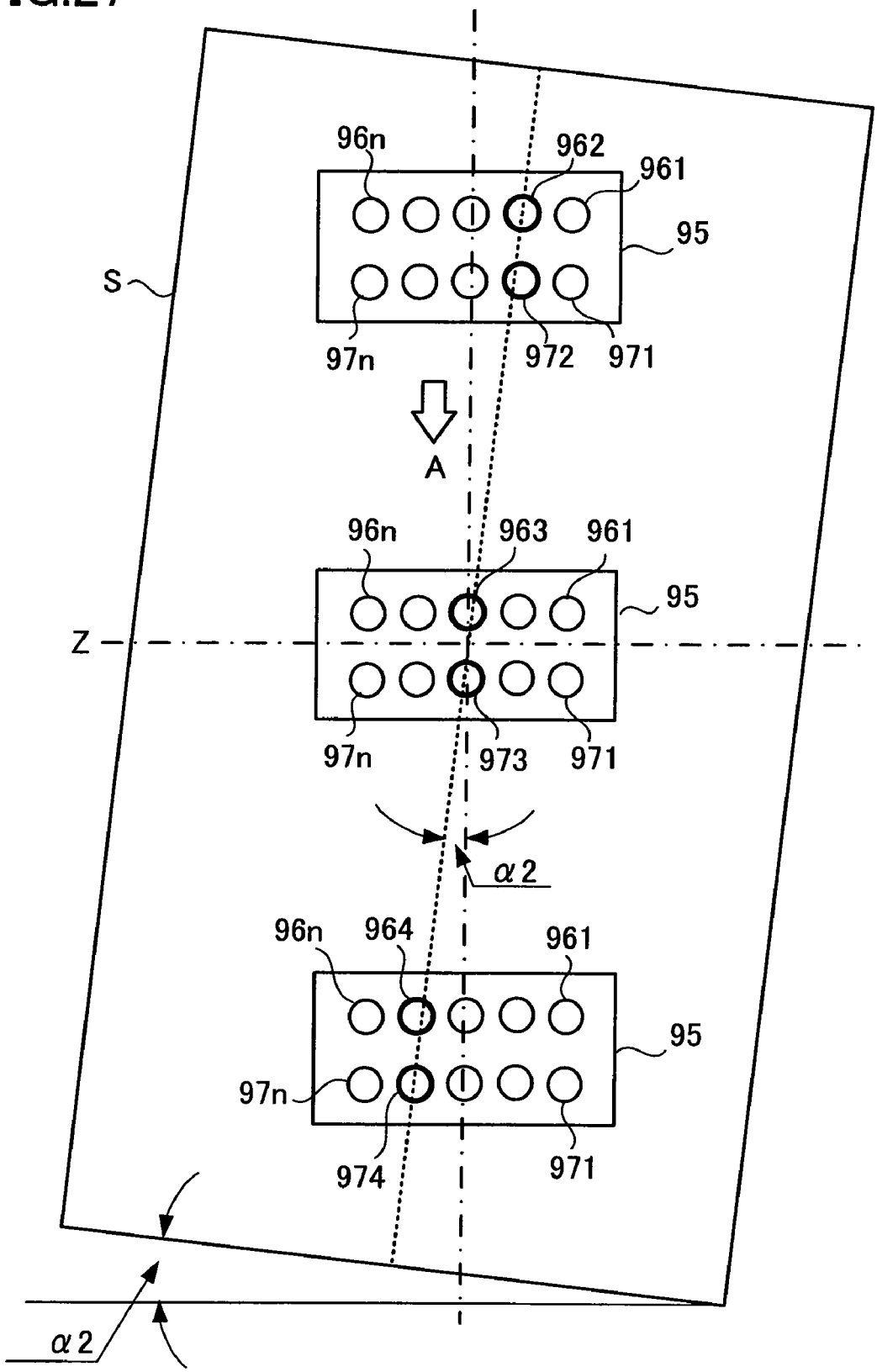
FIG. 27 is an operation explanatory view showing another example of a creasing unit.

FIG. 27 is an operation explanatory view of a modified example of the creasing unit 90. In FIG. 27, a needle drive section 95 including needles 96 and 97 disposed in plural lines (for example, two lines) is disposed in parallel to a conveyance direction Z of a sheet S, and the needle drive section 95 is moved in a direction A orthogonal to the conveyance direction of the sheet S.

The needle drive section 95 alternately drives a pair of the needles 96 and 97 while moving in the arrow A direction. When a skew occurs in the sheet S, a pair of the needles 96 and 97 to be driven is changed according to the skew amount, and the perforations are formed obliquely according to the inclination of the sheet S.

For example, as shown in FIG. 27, it is assumed that the sheet S is inclined by an angle $\alpha 2$ and is conveyed. Besides, when it is assumed that the needle drive section 95 is moved from the upper part to the lower part of the drawing in the arrow A direction, when the needle drive section 95 is at the upper position, the perforations are formed by the pair of needles 962 and 972. When the needle drive section 95 reaches the center position, the perforations are formed by using a pair of needles 963 and 973. When the needle drive section 95 reaches the lower position, the perforations are formed by using a pair of needles 964 and 974.

The perforations can be formed in conformity to the skew of the sheet S by switching the needle pair sequentially according to the movement of the needle drive section 95.

Incidentally, the sensors 61 and 62 detect the skew amount, and the CPU 100 controls which needle pair is driven according to the skew amount. When there is no skew, the perforations are formed using only, for example, the center needle pair 963 and 973.

In the fourth embodiment, since the folding can be performed after the crease is previously formed on the sheet S, the sheet S can be certainly folded. Besides, even if the sheet is skewed, the crease can be formed on the center of the sheet S, and the sheet can be folded at the position where alignment is finely performed.

The present invention is not limited to the above embodiments, and various modifications can be made within the scope not departing from the claims.

Although exemplary embodiments are shown and described, it will be apparent to those having ordinary skill in the art that a number of changes, modifications, or alterations as described herein may be made, none of which depart from the spirit. All such changes, modifications, and alterations should therefore be seen as within the scope.

What is claimed is:

1. A sheet finishing apparatus comprising:

a punching blade that forms a punch hole in a sheet supplied from an image forming apparatus;

a drive mechanism which drives the punching blade between a penetrate position where the punch hole is formed in the sheet and a standby position separate from the sheet;

a punch motor that rotates in a forward direction and a reverse direction and drives the drive mechanism;

a detection section that rotates together with the punch motor and detects a position of the punching blade;

a drive control section that controls the punch motor using position information of the punching blade detected by the detection section and stops the punching blade at the standby position; and a correction control section that measures a first load of the punch motor at the rotation in the forward direction and a second load of the punch motor at the rotation in the reverse direction before the sheet is supplied from the image forming apparatus, and corrects a drive amount of the punch motor after the sheet is supplied from the image forming apparatus according to the first load and the second load.

2. The apparatus of claim 1, wherein when the punching blade is attempted to be stopped at the standby position, the drive control section reversely rotates the punch motor and stops the punching blade at the standby position when the punching blade is stopped after passing through the standby position.

3. The apparatus of claim 1, wherein when the punching blade is attempted to be stopped at the standby position, the drive control section stops the punch motor by PWM driving, short braking and reverse rotation braking, and the correction control section corrects at least one of an on and off period of the PWM driving and a period of the reverse rotation braking based on measurement results of the first load and the second load.

4. The apparatus of claim 1, wherein the correction control section includes a storage section to store information of measurement results of the first load and the second load, and corrects the drive amount of the punch motor based on the information stored in the storage section.

5. The apparatus of claim 1, wherein the correction control section drives the punching blade in a state where the sheet does not exist and measures the load of the punch motor.

6. The apparatus of claim 1, wherein when the first load and the second load are measured, the correction control section drives the punch motor at a lower speed than that of a usual punching operation.

7. The apparatus of claim 1, wherein in an initial mode in which power is turned on, the correction control section rotates the punch motor in the forward direction and the reverse direction to measure the first load and the second load, and when the load of the punch motor is measured in a second mode other than the initial mode, the correction control section rotates the punch motor only in one direction to measure the load, and corrects the drive amount of the punch motor based on respective measurement results.

8. The apparatus of claim 7, wherein the correction control section calculates a difference between the first load and the second load measured in the initial mode, and in the second mode, the correction control section adds the difference to the load at the rotation in the one direction to calculate the load at the rotation in the other direction.

9. A sheet punching apparatus comprising:

a punching blade that forms a punch hole in a sheet;

a drive mechanism which drives the punching blade between a penetrate position where the punch hole is formed in the sheet and a standby position separate from the sheet;

a punch motor that rotates in a forward direction and a reverse direction and drives the drive mechanism;

a detection section that rotates together with the punch motor and detects a position of the punching blade;

a drive control section that controls the punch motor using position information of the punching blade detected by the detection section and stops the punching blade at the standby position; and a correction control section that measures a first load of the punch motor at the rotation in the forward direction and a second load of the punch motor at the rotation in the reverse direction in a state where the sheet does not exist, and corrects a drive amount of the punch motor when the sheet exists according to the first load and the second load.

10. The apparatus of claim 9, wherein when the punching blade is attempted to be stopped at the standby position, the drive control section reversely rotates the punch motor and stops the punching blade at the standby position when the punching blade is stopped after passing through the standby position.

11. The apparatus of claim 9, wherein when the punching blade is attempted to be stopped at the standby position, the drive control section stops the punch motor by PWM driving, short braking and reverse rotation braking, and the correction control section corrects at least one of an on and off period of the PWM driving and a period of the reverse rotation braking based on measurement results of the first load and the second load.

12. The apparatus of claim 9, wherein the correction control section includes a storage section that stores information of measurement results of the first load and the second load, and corrects the drive amount of the punch motor based on the information stored in the storage section.

13. The apparatus of claim 9, wherein when the first load and the second load are measured, the correction control section drives the punching blade at a lower speed than that of a usual punching operation.

14. The apparatus of claim 9, wherein in an initial mode in which power is turned on, the correction control section rotates the punch motor in the forward direction and the reverse direction to measure the first load and the second load, and when the load of the punch motor is measured in a second mode other than the initial mode, the correction control section rotates the punch motor only in one direction to measure the load, and corrects the drive amount of the punch motor based on respective measurement results.

15. The apparatus of claim 14, wherein the correction control section calculates a difference between the first load and the second load measured in the initial mode, and in the second mode, the correction control section adds the difference to the load at the rotation in the one direction to calculate the load at the rotation in the other direction.

16. A control method of a sheet punching apparatus having a punching blade that forms a punch hole in a sheet, a drive mechanism which drives the punching blade between a penetrate position at a side of the sheet and a standby position separate from the sheet, and a punch motor that rotates in a forward direction and a reverse direction and drives the drive mechanism, the method comprising:

controlling rotation of the punch motor to move the punching blade between the penetrate position and the standby position:

detecting movement of the punching blade to the standby position and stopping the punch motor;

measuring a first load of the punch motor at the rotation in the forward direction and a second load of the punch motor at the rotation in the reverse direction in a state where the sheet does not exist; and correcting a drive amount of the punch motor when the sheet exists according to the first load and the second load.

17. The method of claim 16, wherein when the punching blade is attempted to be stopped at the standby position, the punch motor is stopped by PWM driving, short braking and reverse rotation braking, and at least one of an on and off period of the PWM driving and a period of the reverse rotation braking is corrected based on measurement results of the first load and the second load.

18. The method of claim 16, wherein when the first load and the second load are measured, the punching blade is driven at a lower speed than that of a usual punching operation.

19. The method of claim 16, wherein in an initial mode in which power is turned on, the punch motor is rotated in the forward direction and the reverse direction to measure the first load and the second load, in a second mode other than the initial mode, the punch motor is rotated only in one direction to measure the load, and the drive amount of the punch motor is corrected based on respective measurement results.

20. The method of claim 19, wherein a difference between the first load and the second load measured in the initial mode is calculated, and in the second mode, the difference is added to the load at the rotation in the one direction to calculate the load at the rotation in the other direction.

* * * * *